US007249816B2

(12) United States Patent
Kusunoki et al.

(10) Patent No.: US 7,249,816 B2
(45) Date of Patent: Jul. 31, 2007

(54) IMAGE RECORDING APPARATUS AND HEAD DRIVING CONTROL APPARATUS

(75) Inventors: Masanori Kusunoki, Kanagawa (JP); Mitsuru Shingyohuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 292 days.

(21) Appl. No.: 10/487,372

(22) PCT Filed: Sep. 19, 2002

(86) PCT No.: PCT/JP02/09646

§ 371 (c)(1),
(2), (4) Date: Feb. 20, 2004

(87) PCT Pub. No.: WO03/026897

PCT Pub. Date: Apr. 3, 2003

(65) Prior Publication Data

US 2004/0207671 A1 Oct. 21, 2004

(30) Foreign Application Priority Data

Sep. 20, 2001 (JP) ..... 2001-287270
Oct. 18, 2001 (JP) ..... 2001-320420
Feb. 14, 2002 (JP) ..... 2002-036121

(51) Int. Cl.
*B41J 29/38* (2006.01)

(52) U.S. Cl. ..... 347/10; 347/11

(58) Field of Classification Search ..... 347/11, 347/19, 10

See application file for complete search history.

(56) References Cited

U.S. PATENT DOCUMENTS 4,409,596 A * 10/1983 Ishii ..... 347/11
5,774,137 A * 6/1998 Yoshida ..... 347/14
5,933,168 A 8/1999 Sakai
6,092,886 A * 7/2000 Hosono ..... 347/10
6,151,050 A 11/2000 Hosono et al.
6,206,496 B1 * 3/2001 Ushioda ..... 347/10
6,273,538 B1 8/2001 Mitsuhashi et al.
6,312,077 B1 11/2001 Araki
6,328,398 B1 12/2001 Chang
6,402,282 B1 * 6/2002 Webb ..... 347/15
6,598,950 B1 * 7/2003 Hosono et al. ..... 347/11
6,984,010 B2 * 1/2006 Hosono et al. ..... 347/19
2001/0033305 A1 * 10/2001 Tamura ..... 347/19
2002/0018083 A1 2/2002 Sayama
2002/0033852 A1 * 3/2002 Chang ..... 347/9

(Continued)

FOREIGN PATENT DOCUMENTS

EP 0737586 10/1996

(Continued)

*Primary Examiner*—Stephen Meier
*Assistant Examiner*—Jason Uhlenhake
(74) *Attorney, Agent, or Firm*—Cooper & Dunham LLP

(57) ABSTRACT

A head driving control apparatus for driving a pressure generation part in a droplet discharging head outputs a driving signal including: a first waveform element for contracting the volume of a pressurizing chamber without discharging a droplet; a second waveform element for keeping a contracted state until a meniscus in a nozzle moves toward the pressurizing chamber; a third waveform element for expanding the volume of the pressurizing chamber from the contracted state; a fourth waveform element for keeping an expanded state; and a fifth waveform element for contracting the volume of the pressurizing chamber to discharge a droplet.

6 Claims, 24 Drawing Sheets

U.S. PATENT DOCUMENTS

2002/0036667 A1* 3/2002 Shingyohuchi ..... 347/11

FOREIGN PATENT DOCUMENTS

| | | |
|---|---|---|
| EP | 0787589 | 8/1997 |
| EP | 0816081 | 1/1998 |
| EP | 0988974 | 3/2000 |
| EP | 1004441 | 5/2000 |
| JP | 61059911 | 3/1986 |
| JP | 02051734 | 2/1990 |
| JP | 06071882 | 3/1994 |
| JP | 6-91868 | 4/1994 |
| JP | 06297707 | 10/1994 |
| JP | 10024570 | 1/1998 |
| JP | 10114063 | 5/1998 |
| JP | 10166579 | 6/1998 |
| JP | 11268266 | 10/1999 |
| JP | 2000094671 | 4/2000 |
| JP | 2000141642 | 5/2000 |
| JP | 2000-255062 | 9/2000 |
| JP | 2000296610 | 10/2000 |
| JP | 2001158115 | 6/2001 |
| JP | 3216664 | 8/2001 |
| JP | 2002019105 | 1/2002 |
| JP | 3546929 | 4/2004 |
| WO | WO9510416 | 4/1995 |
| WO | WO9737852 | 10/1997 |
| WO | WO9914050 | 3/1999 |
| WO | WO0023278 | 4/2000 |

* cited by examiner

FIG.16

| | S1 | S2 | S3 | S4 | S5 | S6 | S7 |
|---|---|---|---|---|---|---|---|
| Mj1 (LARGE) | 0 | 0 | 1 | 1 | 1 | 1 | 0 |
| Mj2 (MEDIUM) | 1 | 0 | 0 | 1 | 0 | 1 | 0 |
| Mj3 (SMALL) | 1 | 0 | 0 | 0 | 0 | 1 | 1 |
| NON-DISCHARGE DRIVING | 1 | 0 | 0 | 0 | 0 | 0 | 0 |

FIG.18

| | S1 | S2 | S3 | S4 | S5 | S6 | S7 | S8 |
|---|---|---|---|---|---|---|---|---|
| Mj1 (LARGE) | 0 | 0 | 1 | 1 | 1 | 1 | 0 | 1 |
| Mj2 (MEDIUM) | 1 | 0 | 0 | 1 | 0 | 1 | 0 | 1 |
| Mj3 (SMALL) | 1 | 0 | 0 | 0 | 0 | 1 | 1 | 1 |
| NON-DISCHARGE DRIVING | 0 | 0 | 0 | 0 | 0 | 0 | 0 | 1 |

IMAGE RECORDING APPARATUS AND HEAD DRIVING CONTROL APPARATUS

TECHNICAL FIELD

The present invention relates to an image recording apparatus such as an inkjet printer, and a head driving control apparatus for the image recording apparatus.

BACKGROUND ART

An inkjet recording apparatus used as an image recording apparatus (an image forming apparatus) such as a printer, a facsimile, a copier, a plotter and the like is provided with an inkjet head as a droplet discharging head. The inkjet head includes nozzles for discharging ink droplets, ink channels (the ink channel may be called a discharge chamber, a pressure chamber, a pressurizing fluid chamber, a fluid chamber, a pressurizing chamber or the like) each of which is connected to the nozzles, and pressure generation parts for pressurizing ink in the ink channels. Although there are various kinds of droplet discharging heads such as for discharging fluid resists as droplets, or for discharging a sample of DNA as droplets, for example, the inkjet head will be mainly described as in the following description.

As for the inkjet head, a piezo type (Japanese laid-open patent application No. 2-51734), a thermal type (Japanese laid-open patent application No. 61-59911), and an electrostatic type (Japanese laid-open patent application No. 6-71882) are known. In the piezo type, a vibration plate forming a wall of the ink channel is deformed by using a piezoelectric element that is a pressure generation part for pressurizing ink in the ink channel, so that the volume of the ink channel is changed and ink droplets are discharged. In the thermal type, ink droplets are discharged by using pressure caused by bubbles that are generated by heating ink in the ink channel by using a heating resistor. In the electrostatic type, the vibration plate that forms a wall of the ink channel and an electrode are placed opposingly, and the vibration plate is deformed by using electrostatic force between the vibration plate and the electrode, so that the volume of the ink channel is changed and ink droplets are discharged.

In these inkjet heads, either of two methods is used for discharging ink droplets. One method is a "push and shoot" method in which the vibration plate is pushed toward the pressurizing chamber, so that the volume of the pressurizing chamber is decreased and ink droplets are discharged. Another method is a "pull and shoot" method in which the vibration plate is deformed by a force toward the outside of the ink chamber first (away from the nozzles)), and then the vibration plate is returned to its original position, such that the volume that is once enlarged is returned to its original the volume, so that ink droplets are discharged.

For example, a domestic re-publication of PCT international publication for patent application No. WO95/10416 discloses a driving method of the piezo type head using the "pull and shoot" method. The PCT application discloses a driving method used for the inkjet head for discharging ink in the pressurizing chamber by using a stacked piezoelectric actuator unit, wherein the stacked piezoelectric actuator unit includes a substrate and a plurality of rows each including a pair of stacked piezoelectric actuators. The stacked piezoelectric actuator has piezoelectric distortion constant d33 and is provided with collection electrodes on both end surfaces, and the pair of stacked piezoelectric actuators are arranged on the substrate such that the pair of stacked piezoelectric actuators are opposed to each other. In the driving method, in first step, a voltage is applied to the stacked piezoelectric actuators in a polarization direction of the stacked piezoelectric actuators so as to lengthen the stacked piezoelectric actuators in the thickness direction. In second step, ink is filled in the pressurizing chamber by decreasing the voltage gradually. In third step, the ink is discharged by lengthening the stacked piezoelectric actuators in the thickness direction by abruptly increasing the voltage again.

However, in the conventional "pull and shoot" method by using the above-mentioned piezoelectric element (piezoelectric vibrator) of d33 deformation, there is a problem in that the voltage is always applied to the piezoelectric element even when printing is not performed, so that reliability of the piezoelectric element, and by extension, reliability of the head, decreases.

As another example of the inkjet head adopting the "pull and shoot" method, Japanese laid-open patent application No.11-268266 discloses an inkjet printer that adopts the "pull and shoot" method. Japanese laid-open patent application No. 11-268266 discloses a driving signal for a piezoelectric vibrator in an inkjet head, in which the driving signal includes pulses for controlling the head in the following way.

A potential difference $\Delta V1$ of the driving signal between before and after expansion of a pressure chamber is set to be greater than a potential difference $\Delta V2$ of the driving signal between before and after contraction of the pressure chamber. Accordingly, the pressure chamber is contracted from a state in which the meniscus (free surface) of ink is largely pulled from the nozzle aperture, so that an ink droplet for a small dot is discharged. The weight of the ink droplet can be further decreased by optimizing the driving signal for the small dot, so that the diameter of the recorded dot can be further decreased.

However, there is a problem in that it is difficult to optimize the driving signal for the small dot only by setting the potential difference $\Delta V1$ of the driving signal to be greater than the potential difference $\Delta V2$ of the driving signal.

That is, according to verification by the inventor of the present invention, it is necessary to perform optimization between a discharge pulse (discharge pulse 114 in Japanese laid-open patent application No.11-268266, "discharge pulse" means "electrical discharge pulse" hereinafter) included in the driving signal and a charge pulse (charge pulse 116 in Japanese laid-open patent application No. 11-268266) in order to make the most of pressure vibration in the ink pressure chamber that occurs when applying the discharge pulse. That is, it is necessary to optimize the voltage holding time during which constant voltage is kept, time for applying the discharge pulse, and time for applying the charge pulse. That is, it can be realized to set the potential difference $\Delta V1$ to be greater than the potential difference $\Delta V2$ only when such optimization is realized.

As still another example of a conventional technology, Japanese laid-open patent application No.6-297707 discloses an inkjet recording apparatus, in which the volume of a pressure chamber is expanded and ink is filled in the pressure chamber, and, after that, ink is discharged by contracting the volume of the pressure chamber. In this process, the speed for expanding the volume of the pressure chamber in the first stage is changed according to recording characteristics of a recording medium, so that only ink discharge amount can be freely changed while ink discharge speed is kept to be constant.

As for an inkjet head that uses high viscosity ink, it is necessary to shorten the time for refilling ink from an ink supply chamber for obtaining good frequency characteristics. Therefore, fluid resistance Ro of a fluid resistance part that connects the ink pressure chamber and the ink supply chamber needs to be small. In a case where the inkjet head is driven by a conventional driving signal having a pulse waveform shown in FIG. 1 for an inkjet recording apparatus adopting the "pull and shoot" method, when volume expanding speed of the ink pressure chamber is large (that is, when ΔV/Tfs shown in FIG. 1 is large), a negative pressure in the ink pressure chamber becomes large, and the supply of ink from the ink supply chamber is performed speedily since the fluid resistance Ro is small. Therefore, pulled depth of the nozzle meniscus cannot be large. That is, as shown in FIG. 1, a discharge pulse 101 is output for a period of time Tfs during which the voltage decreases from the voltage of the holding pulse 100. Then, a holding pulse 102 (voltage Vpb) is output for a time period of Pws, and a charge pulse 103 in which the voltage increases for a time period Trm is output. After that, the voltage of the pulse becomes Vps (holding pulse 104). On the other hand, if the volume expanding speed of the ink pressure chamber is decreased, pressure in the ink supply chamber cannot be increased. Thus, it cannot be expected to realize efficient ink discharge by using the pressure in the ink supply chamber.

FIG. 2 shows a relationship between the time Pws in the pulse waveform and the depth of the meniscus from the nozzle surface of the inkjet head. In FIG. 2, the voltage Vps is applied to the piezoelectric vibrator by the holding pulse 100, so that the piezoelectric vibrator is charged and extended. As a result, volume of the ink pressure chamber decreases. Next, the piezoelectric vibrator is extended by discharging the piezoelectric vibrator to the voltage Vpb by the discharge pulse 101, so that the volume of the ink pressure chamber is expanded. At this time, pressure occurs in the ink supply chamber, wherein the magnitude of the pressure vibrates at a period Ts. Thus, since negative pressure occurs first, the meniscus is pulled toward the inside of the ink pressure chamber. Then, ink starts to be supplied gradually from the ink supply chamber. As a result, as the ink is supplied, the meniscus that is once pulled in gradually rises to the surface of the nozzle while the meniscus performs damped vibration for a period of Ts. Considering that high viscosity ink is used and fluid resistance Ro is small, when voltage ΔV is set to be constant and the time Tfs is set to be short, the meniscus depth is small and the amplitude of the vibration is large. If the time Tfs is set to be longer, the meniscus depth becomes deep and the amplitude becomes small. It is known that the meniscus depth has a close relationship with ink droplet amount to be discharged, and the amplitude of the vibration has a close relationship with ink discharge speed. That is, when it is intended to obtain a small ink droplet by using a large meniscus depth, desired ink discharge speed cannot be obtained. Thus, a large discharge voltage is necessary. However, when ink discharge speed is increased by using a large discharge voltage, the ink discharge amount becomes large at the same time. Thus, the desired size of a small ink droplet cannot be obtained.

As for the technique disclosed in Japanese laid-open patent application No.6-297707, volume expanding speed of the pressure chamber of the inkjet head can be changed freely, so that only the ink discharge amount can be changed freely. However, the ink discharge speed becomes slow. Therefore, printing speed is lowered, and printing image quality is lowered due to variations of positions of ink droplets projected on a recording medium.

DISCLOSURE OF THE INVENTION

It is a first object of the present invention to provide a head driving control apparatus and an image recording apparatus for improving reliability of a droplet discharging head such as an inkjet head in the image recording apparatus.

It is a second object of the present invention to provide an image recording apparatus for discharging an optimized small droplet.

The above-mentioned object is achieved by a head driving control apparatus for controlling a pressure generation part that contracts and expands volume of a pressurizing chamber connected to a nozzle in a droplet discharging head, the head driving control apparatus comprising:

a driving waveform generation part for outputting a driving signal including:

a first waveform element for contracting volume of the pressurizing chamber without discharging a droplet;

a second waveform element for keeping a contracted state in which volume of the pressurizing chamber is contracted until a meniscus in the nozzle moves toward the pressurizing chamber;

a third waveform element for expanding the volume of the pressurizing chamber from the contracted state;

a fourth waveform element for keeping an expanded state of the volume of the pressurizing chamber; and a fifth waveform element for contracting volume of the pressurizing chamber from the expanded state to discharge a droplet.

According to this invention, the driving voltage can be applied only when printing is performed. Thus, the time for applying voltage on the pressure generation part can be shortened, so that reliability increases.

In addition, the above-mentioned object is achieved by an image recording apparatus including a droplet discharging head, the droplet discharging head comprising a pressurizing chamber, a nozzle connected to the pressurizing chamber, a pressure generation part for contracting and expanding the volume of the pressurizing chamber, the image recording apparatus comprising:

a driver for driving the pressure generation part;

wherein the driver outputs a driving signal including:

a first waveform element for expanding the pressurizing chamber;

a second waveform element for keeping the expanded state of the pressurizing chamber; and a third waveform element for contracting the pressurizing chamber from the expanded state to discharge a droplet;

wherein a pulse width of the second waveform element is determined such that droplet discharge speed is greater than a predetermined value.

In this invention, the pulse width of the second waveform element may be determined such that droplet discharge speed is maximized. According to this invention, the image recording apparatus can make the most of pressure vibration in the pressurizing chamber caused by applying the first waveform element, so that an optimized small droplet can be obtained and the voltage of the third waveform element can be lowered.

Further, the above-mentioned object is achieved by an image recording apparatus including a droplet discharging head, the droplet discharging head comprising a pressurizing chamber, a fluid supply chamber connected to the pressurizing chamber, a nozzle connected to the pressurizing chamber, and a pressure generation part for contracting and expanding the volume of the pressurizing chamber, the image recording apparatus comprising:

a driver for driving the pressure generation part;

wherein the driver outputs a driving signal including:

a first waveform element for expanding the pressurizing chamber by causing a first pressure in the pressurizing chamber;

a second waveform element for expanding the pressurizing chamber by causing a second pressure larger than the first pressure in the pressurizing chamber;

a third waveform element for keeping an expanded state of the pressurizing chamber expanded by the second waveform element; and a fourth waveform element for contracting the pressurizing chamber from the expanded state to discharge a droplet.

According to this invention, the first waveform element enables slowing the speed of expanding the volume of the pressurizing chamber, so that the pressure in the fluid supply chamber (ink supply chamber) can be decreased and ink supply from the fluid supply chamber can be slowed. As a result, the meniscus can be pulled by using the first waveform element. Then, the second signal enables increasing the speed of expanding the volume of the pressurizing chamber to increase the pressure in the fluid supply chamber. As a result, voltage used for discharging ink can be decreased. Thus, a small droplet can be obtained while enough droplet discharge speed is kept.

Other objects, features and advantages of the present invention will become more apparent from the following detailed description when read in conjunction with the accompanying drawings.

BRIEF DESCRIPTION OF THE DRAWINGS

FIG. 16 is a figure for explaining selection conditions in the fourth embodiment;

FIG. 18 is a figure for explaining selection conditions in the fifth embodiment;

BEST MODE FOR CARRYING OUT THE INVENTION

In the following, embodiments of the present invention corresponding to the first object will be described with reference to figures.

Figure 1:
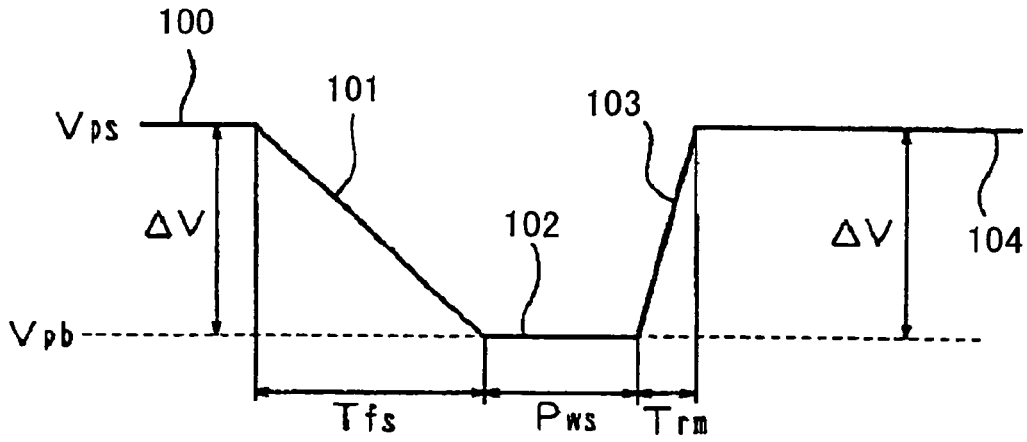
FIG. 1 shows a waveform of a conventional driving signal for an inkjet recording apparatus.
Figure 2:
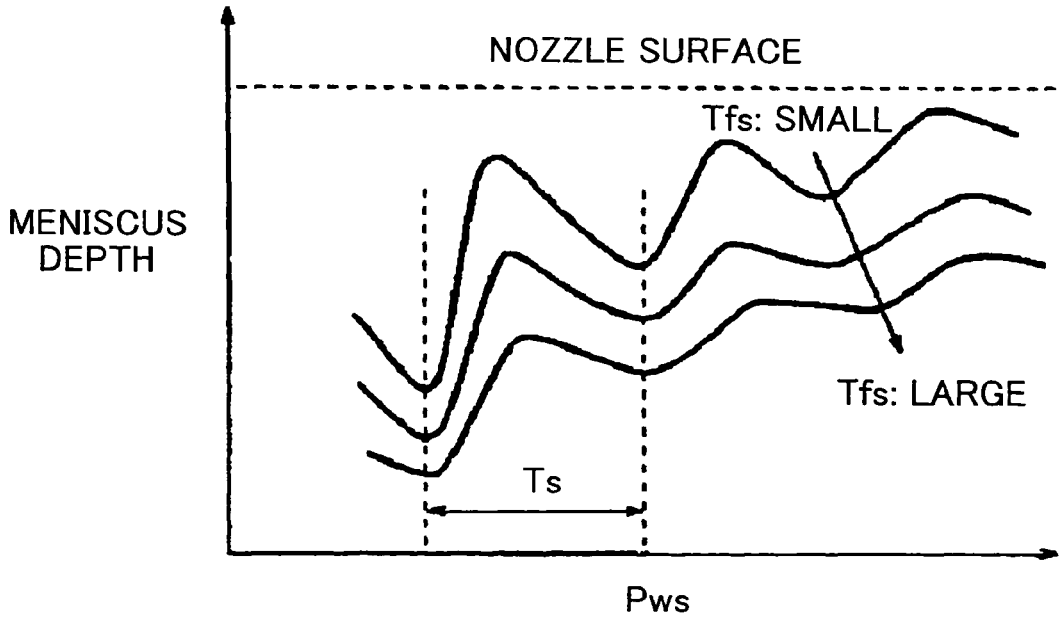
FIG. 2 is a graph for explaining the operation by the driving signal shown in FIG. 1.
Figure 3:
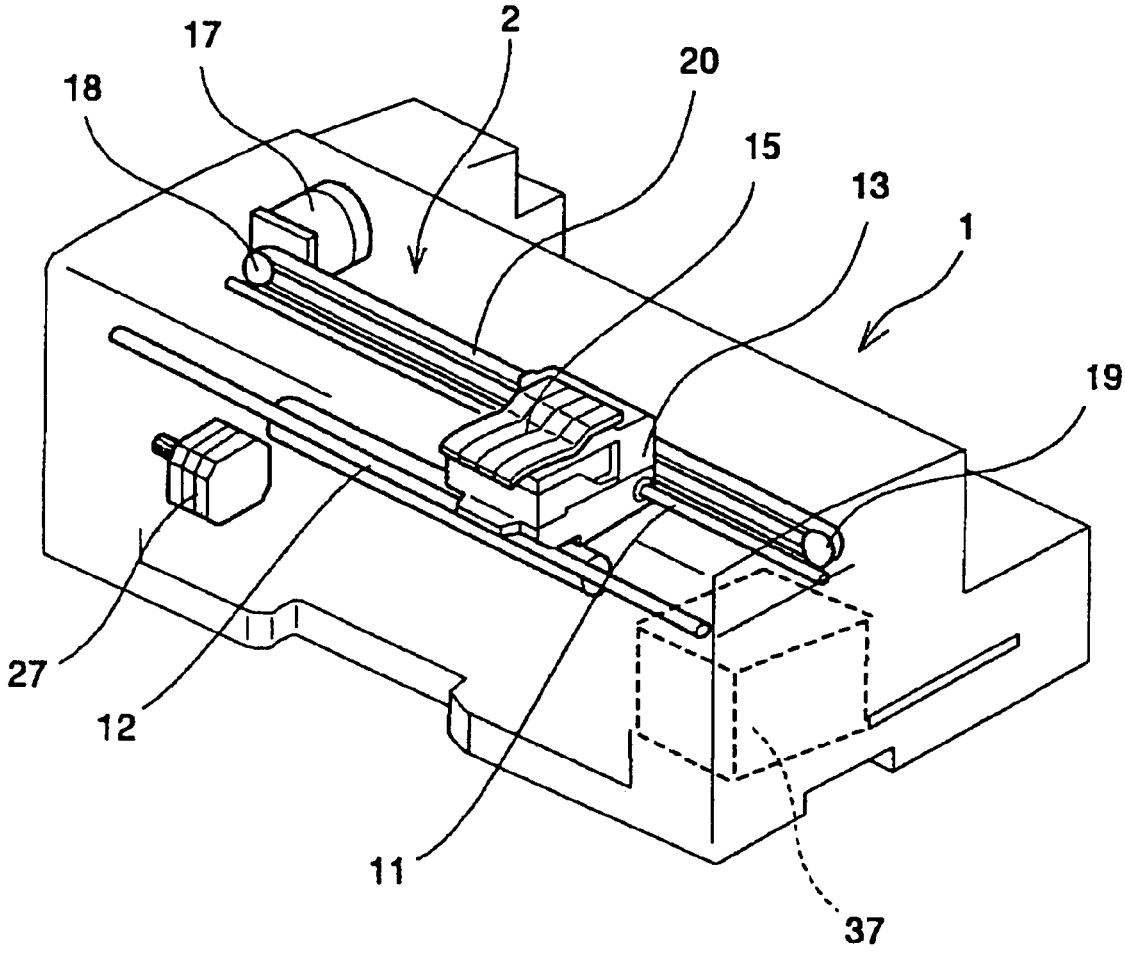
FIG. 3 is a perspective view showing a schematic configuration of an inkjet recording apparatus according to an embodiment of the present invention.
Figure 4:
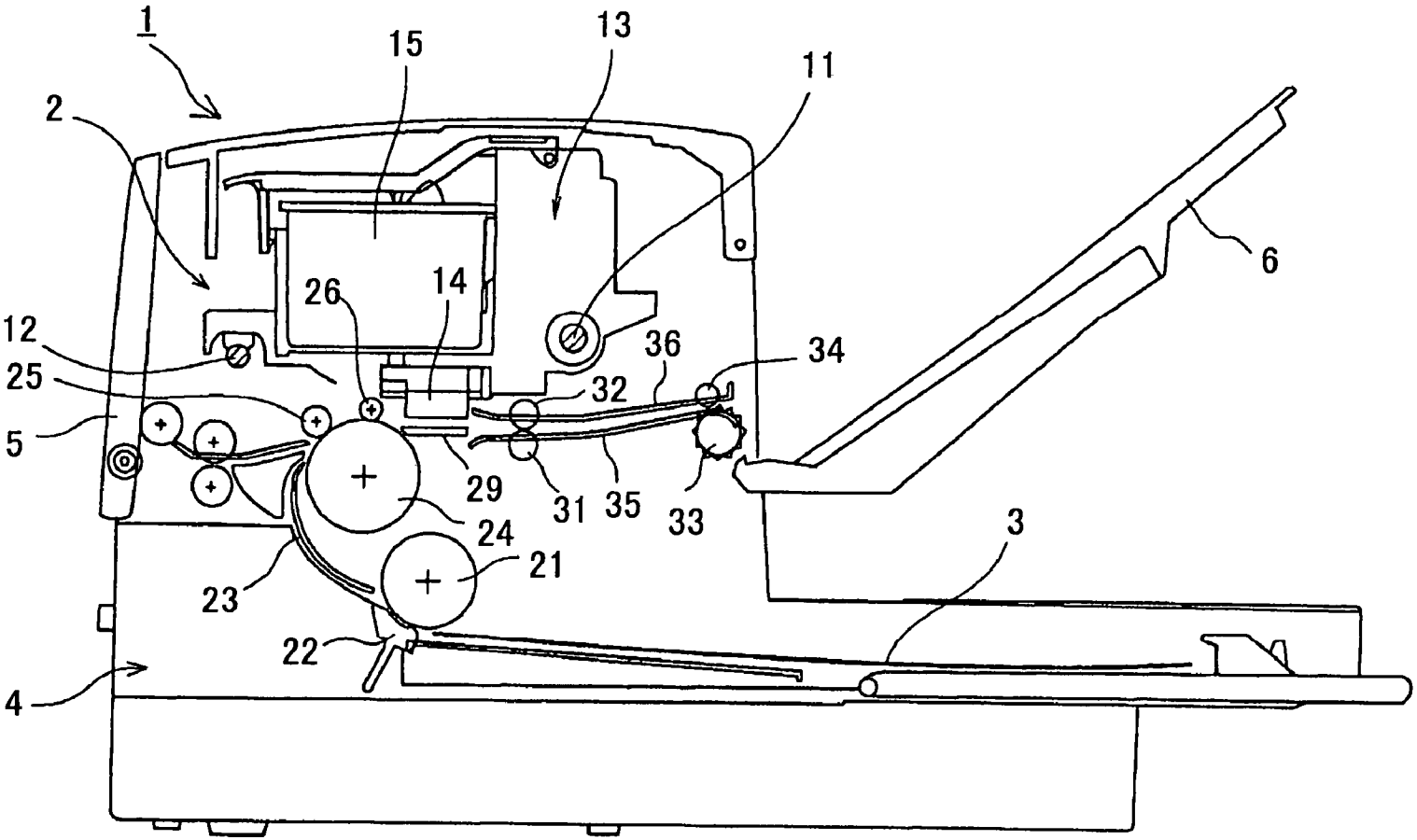
FIG. 4 shows a section view of the inkjet recording apparatus.

FIG. 3 is a perspective view showing a schematic configuration of an inkjet recording apparatus as the image recording apparatus according to an embodiment of the present invention. FIG. 4 shows a section view of the inkjet recording apparatus. As shown in FIGS. 3 and 4, the inkjet recording apparatus includes a printing mechanism part 2 formed by a carriage 13 movable in a main scanning direction, recording heads formed by inkjet heads 14 mounted on the carriage 13, and an ink cartridge 15 for supplying ink to the inkjet head 14 in the inside of a main body 1, wherein the inkjet head is an example of a droplet discharging head. A paper feed cassette 4 (or a paper feed tray 5) that can carry paper 3 can be attached removably under the main body 1 of the apparatus. A manual bypass tray 5 can be opened or closed. In the inkjet recording apparatus, the paper supplied from the paper feed cassette 4 or the manual bypass tray 5 is captured, and after necessary images are printed by the printing mechanism part 2, the paper is ejected to an output tray 6 attached in the back side of the printer.

The printing mechanism part 2 holds the carriage 13 by using a main guide rod 11 and a side guide rod 12 that are guide members spanning between side plates that form the housing of the main body 1, such that the carriage 13 freely moves in a main scanning direction (in a direction perpendicular to the surface of the paper in FIG. 4). The carriage 13 is provided with inkjet heads 14 that discharge ink droplets of yellow (Y), cyan (C), magenta (M), and black (Bk), wherein the carriage is attached such that the direction in which ink droplets are discharged is downward. Ink cartridges 15 for supplying ink of each color to the inkjet heads 14 are attached to the carriage 13 removably.

The ink cartridge 15 has an air vent at the top of the ink cartridge 15, and an opening for supplying ink to the inkjet heads 14 at the lower part. In addition, the ink cartridge 15 includes a porous material into which ink is filled, wherein ink to be supplied to the inkjet heads 14 is kept under a slightly negative pressure by using capillary attraction of the porous material.

The rear part (lower reaches of the paper feed direction) of the carriage 13 is supported by the main guide rod 11 such that the carriage 13 moves freely, and the forward part (upper reaches of the paper feed direction) is supported by the side guide rod 12 such that the carriage 13 moves freely. A timing belt 20 is looped over a driving pulley 18 that are rotated by a main scanning motor 17 and an idler pulley 19 for moving the carriage 13 in the main scanning direction. The carriage 13 is fixed to the timing belt 20, so that the carriage 13 reciprocates by reciprocal rotation of the main scanning motor 17.

In this embodiment, inkjet heads 14 are used for each color. However, one inkjet head having nozzles for discharging ink droplets of each color can be used. As for the inkjet head 14, a piezo type inkjet head is used, wherein the inkjet head 14 has a vibration plate that is deformed by a piezoelectric element (piezoelectric vibrator).

In addition, for transferring the paper 3 set in the paper feed cassette 4 to the downside of the inkjet head 14, the inkjet recording apparatus is provided with a paper feed roller 21 and a friction pad 22 for feeding a paper 3 from the paper feed cassette 4, a guide member 23 for guiding the paper 3, a transfer roller 24 for turning around the paper 3 and transferring the paper 3, a transfer roller 25 pushed on the surface of the transfer roller 24 and a head roller 26 that defines forwarding angle of the paper 3 from the transfer roller 24. The transfer roller 24 is rotated via a row of gears by a subscanning motor 27.

In addition, the inkjet recording apparatus is provided with a printing support member 29 that is a guide member for guiding the paper 3 transferred from the transfer roller 24 under the bottom of the inkjet head 14 in response to a moving range of the carriage 13 in the main scanning direction. In addition, a transfer roller 31 rotated for transferring the paper 3 to the output direction, and a spur 32 are provided in the lower reaches of the paper transfer direction of the printing support member 29. In addition, the inkjet recording apparatus includes a paper ejection roller 33 and a spur 34 for transferring the paper 3 to the output tray 6, and guide members 35 and 36 forming paper ejection route.

When recording an image on a paper, the inkjet head 14 is driven according to image signals while moving the carriage 13, so that images for one line are recorded by projecting ink on the paper 3 while the paper 3 is stopped. When the recording apparatus receives a recording end signal or a signal indicating that the rear end of the paper 3 reaches the recording region, recording operation ends and the paper 3 is ejected.

A recovery device 37 for recovering discharge failures of the inkjet head 14 is provided in a position at the right end in the moving direction of the carriage 13 and to the outside of the recording region. The recovery device includes a cap means, an aspirating means, and a cleaning means. The carriage 13 is positioned at the side of the recovery device 37 while waiting for printing, so that the cap means caps the inkjet head 14 for protecting against discharge faults due to drying of ink by keeping the discharge orifices wet. In addition, by discharging ink that is not used for printing while printing is in progress, ink viscosity can be kept constant for all discharge orifices so that stable discharge performance can be obtained.

When a discharge fault occurs, discharge orifices of the inkjet head 14 are sealed by the cap means, bubbles and ink are discharged from the discharge orifices via a tube by the aspirating means, and ink and dust on the surface of the discharge orifices are removed by the cleaning means, so that the discharge fault is corrected. The aspirated ink is ejected to a waste ink receiver (not shown in the figure) that is provided under the main body and the waste ink is absorbed and held in an ink absorption material in the waste ink receiver.

Figure 5:
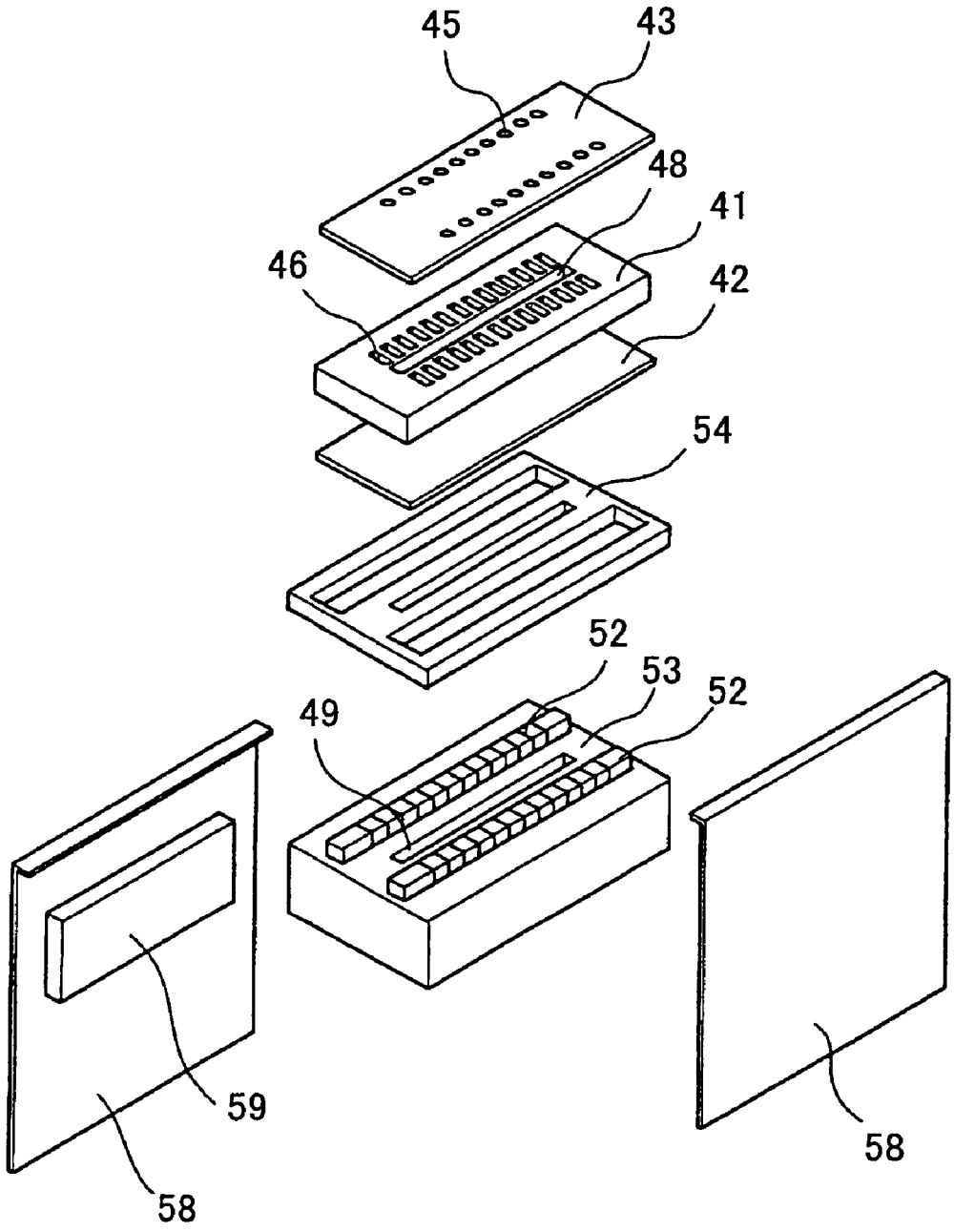
FIG. 5 is an exploded view of the inkjet head.
Figure 6:
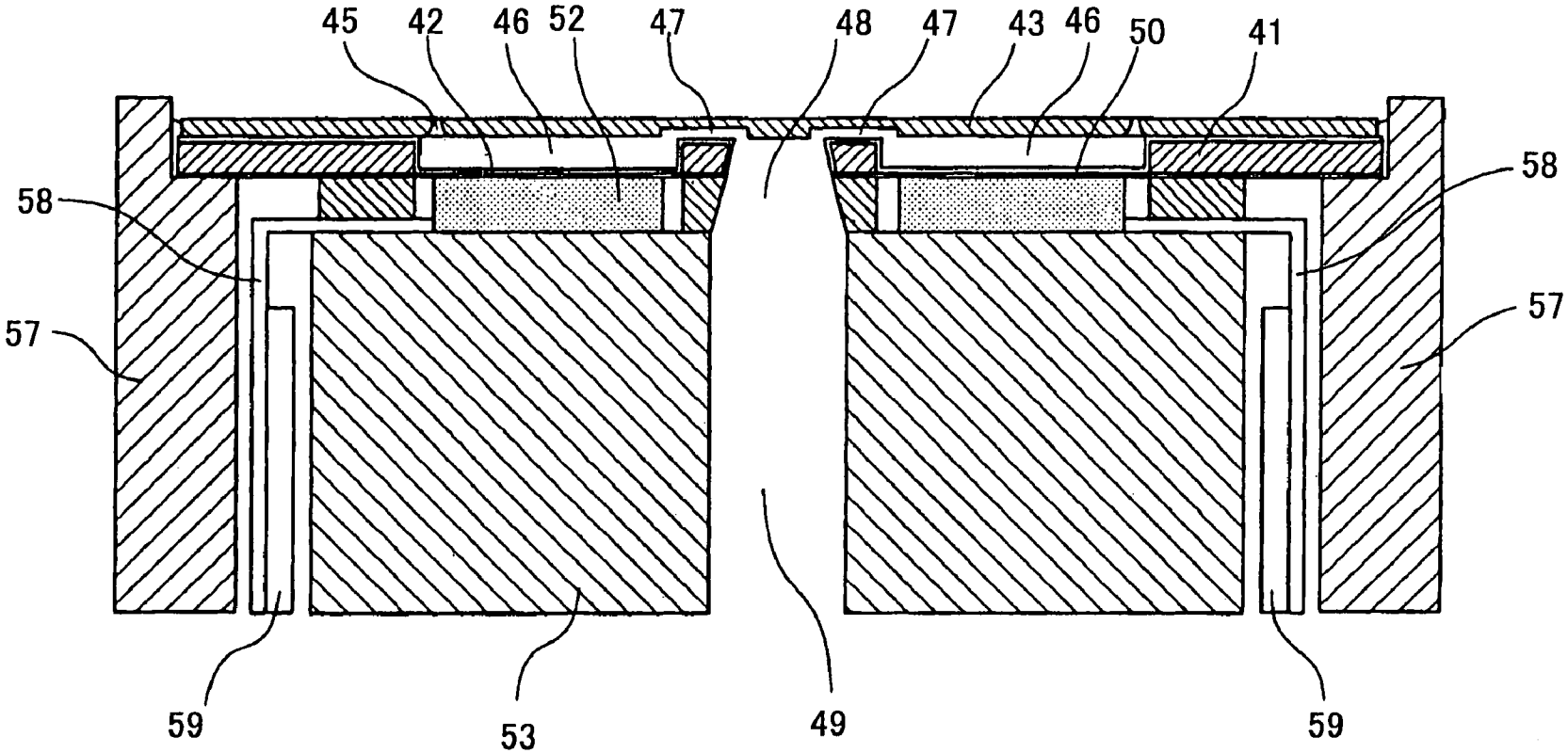
FIG. 6 shows a section view of the head in the direction of the length of a fluid chamber.

Next, the inkjet head 14 of the inkjet recording apparatus will be described with reference to FIGS. 5-8. FIG. 5 is an exploded view of the head, FIG. 6 shows a section view of the head in the direction of the length of a fluid chamber, FIG. 7 is a magnified view of a main part of FIG. 6, and FIG. 8 is a section view in the direction of perpendicular to the length of the fluid chamber.

The inkjet head includes a channel forming substrate (channel forming member) 41, a vibration plate 42 connected to the undersurface of the channel forming substrate 41, a nozzle plate 43 connected to the top surface of the channel forming substrate 41, in which pressurizing chambers 46 and a common fluid chamber 48 are formed. The pressurizing chamber 46 is an ink channel to which a nozzle 45 that discharges ink droplets (that are fluid droplets) is connected. The common fluid chamber 48 supplies ink to the pressurizing chambers 46 via an ink supply route 47 that acts as a fluid resistance. In addition, liquid registrant thin films 50 are provided to all surfaces of walls of the pressurizing chambers 46, the ink supply routes 47 and the common fluid chamber 48 in the channel forming substrate 41, wherein the walls contact with ink.

A stacked piezoelectric vibrator 52 is provided for each pressurizing chamber 46 in the side of the outside surface (opposite to the fluid chamber) of the vibration plate 42, wherein each stacked piezoelectric vibrator 52 is fixed to a base substrate 53, and a spacer member 54 is connected to the base substrate 53 such that the spacer member 54 surrounds the rows of the stacked piezoelectric vibrators 52.

Figure 7:
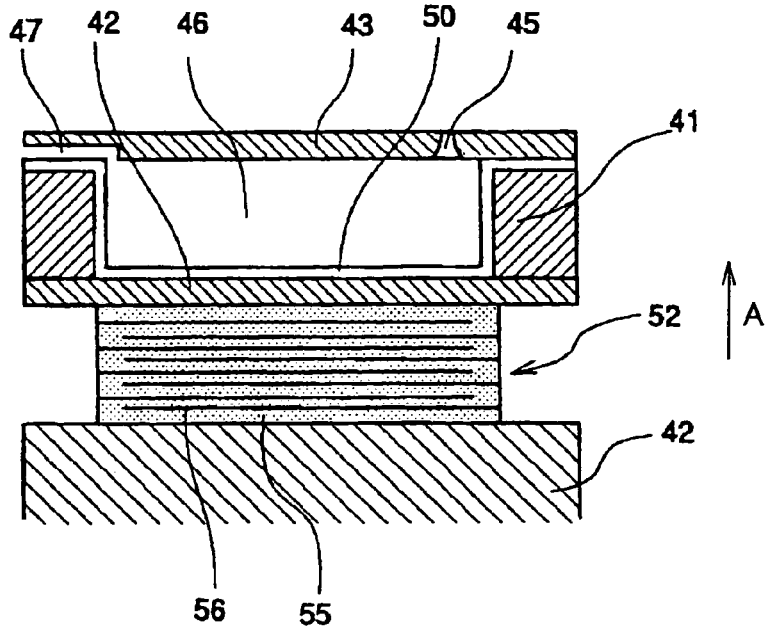
FIG. 7 is a magnified view of a main part of FIG. 6.
Figure 8:
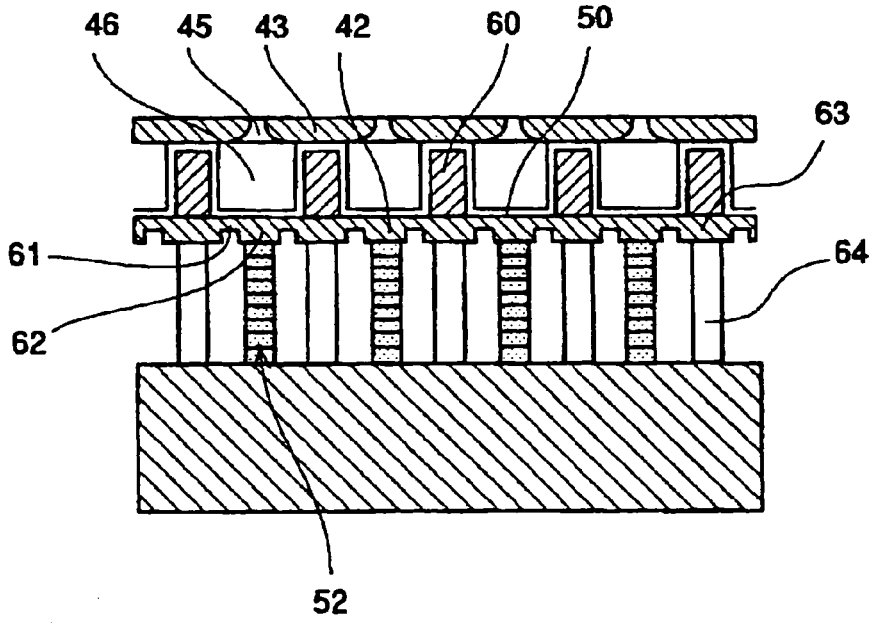
FIG. 8 is a section view in the direction of perpendicular to the length of the fluid chamber.

Also as shown in FIG. 7, the piezoelectric vibrator 52 is formed by stacking a piezoelectric material 55 and an inside electrode 56 alternately. Piezoelectric constant of the piezoelectric vibrator 52 is d33. By expanding and contracting the piezoelectric vibrator 52, the pressurizing chamber 46 can be contracted and expanded. When the piezoelectric vibrator 52 is charged by applying a driving signal, the piezoelectric vibrator 52 expands in the direction of the arrow A in FIG. 7. When the piezoelectric vibrator 52 is discharged, it contracts in the direction opposite to the arrow A. A through hole forming an ink supply opening 49 is formed in the base substrate 53 and the spacer member 54, so that the supply opening 49 is used for supplying ink to the common fluid chamber 48 from the outside.

The outside surface of the channel forming substrate 41 and the outer edge on the undersurface side of the vibration plate 42 are bonded to head frames 57 that are formed by injection molding by using epoxy resin or polyphenylene sulfide. The head frames 57 and the base substrate 53 are bonded to each other by adhesive and the like (not shown in the figure). An FPC cable 58 is connected to the piezoelectric vibrator 52 by solder, ACF (anisotropic conductive film) or wire bonding for providing a driving signal. The FPC cable 58 implements a driving circuit (driver IC) 59 for selectively applying a driving waveform to each piezoelectric vibrator.

Through holes corresponding to each pressurizing chamber 46, ditches corresponding to the ink supply route 47, and a through hole corresponding to the common fluid chamber 48 in the channel forming substrate 41 are formed by performing anisotropy etching on a (110) oriented single crystal silicon substrate by using alkaline etching fluid such as potassium hydroxide aqueous solution (KOH).

The vibration plate 42 is formed from a nickel metal plate by an electroforming method. Corresponding to each pressurizing chamber 46, the vibration plate 42 has thin parts 61 for easily deforming the vibration plate 42 at a position corresponding to the pressurizing chamber 46, a thick part 62 for connecting to the piezoelectric vibrator 42, and a thick part 63 at a position corresponding to a wall between fluid chambers. The flat surface side of the vibration plate 42 is bonded to the channel forming substrate 41 by adhesive, and the thick parts are bonded to the frame 17 by adhesive. Columns 64 are provided between the thick part 63 and the base substrate 53. The column 64 has the same structure as the piezoelectric vibrator 52.

Nozzles 45 each diameter being 10-30 μm and each corresponding to a pressurizing chamber 46 are formed in the nozzle plate 43, and the nozzle plate 43 is bonded to the channel forming substrate 41 by adhesive. As a material of the nozzle plate 43, a metal such as stainless steel and nickel, combination of a metal and a resin such as a polyimide resin film, silicon, or combination of these can be used. A repellent film is formed on the nozzle surface (surface of discharging direction: discharge surface) by a known method such as plating or water repellent coating in order to obtain water repellency for ink.

Figure 9:
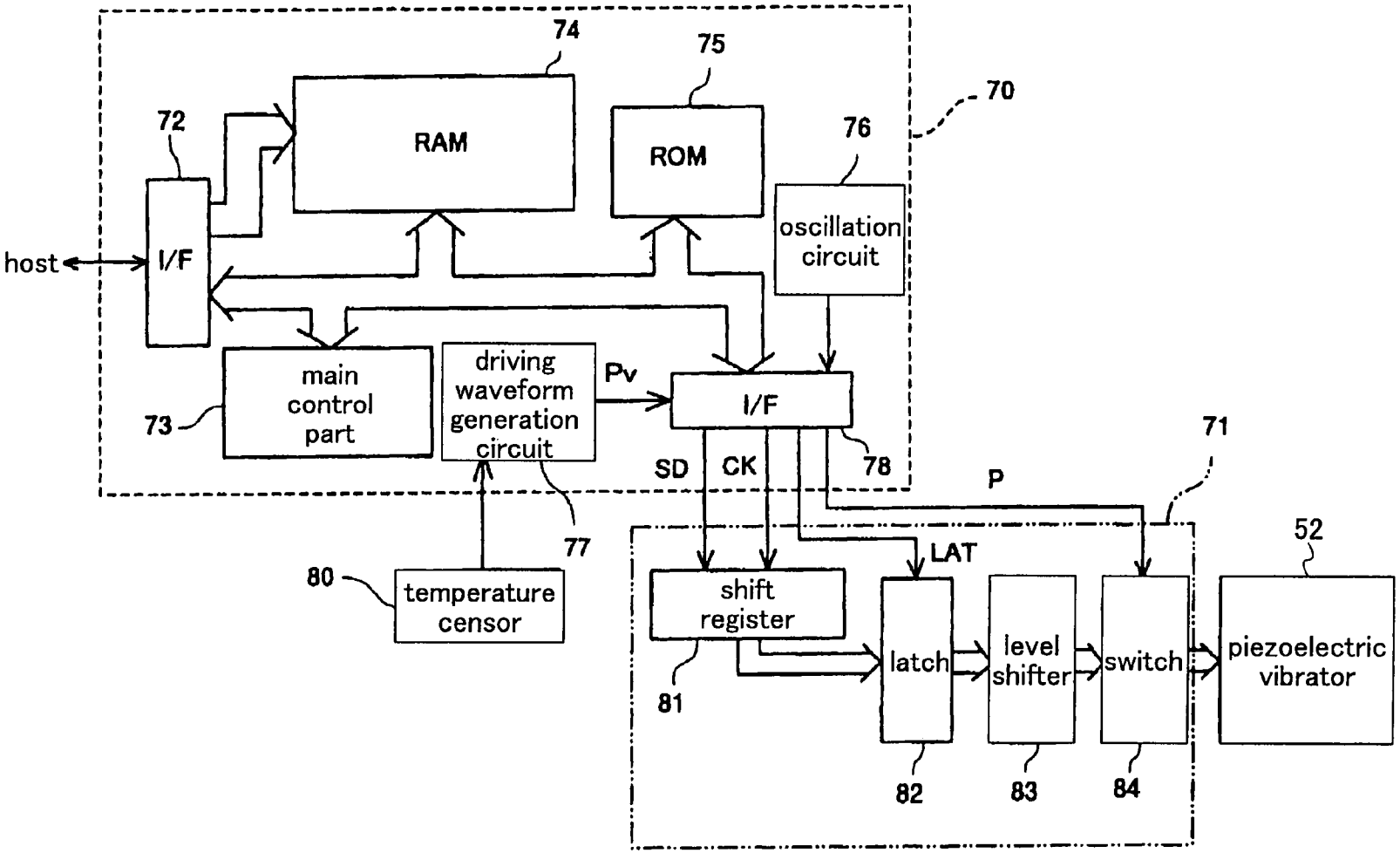
FIG. 9 shows a control part of the inkjet recording apparatus.

Next, a control part of the inkjet recording apparatus will be described with reference to FIG. 9. The control part corresponds to a head driving control apparatus.

The control part includes a printer controller 70 and an engine controller including a head driving circuit 71. The printer controller 70 includes an interface 72 (to be referred to as I/F hereinafter) for receiving printing data and the like from a host computer and the like via a cable or a network, a main control part 73 having a CPU and the like, a RAM 74 for storing data, a ROM 75 for storing routines and the like for processing the data, an oscillation circuit 76, a driving signal generation circuit 77 as a driving waveform generation part for generating a driving waveform Pv to be supplied to the inkjet head 14, and an I/F 78 for sending printing data developed to dot pattern data (bit map data) and driving waveform and the like to the driving circuit 71.

The RAM 74 is used for various kinds of buffers and work memory and the like. The ROM 75 stores various kinds of control routines executed by the main control part 73, font data, graphic functions and various kinds of procedures. The main control part 73 reads printing data from receiving buffers in the I/F 72, converts the printing data into intermediate codes, stores the intermediate codes in intermediate buffers formed by predetermined areas of the RAM 74, develops read intermediate code data into dot pattern data by using font data stored in the ROM 75, and stores the dot pattern data into a predetermined area in the RAM 74.

When the main control part 73 obtains dot pattern data corresponding to one line of the inkjet head 14, the main control part 73 sends the dot pattern data of one line to the head driving circuit 71 as serial data SD via the I/F 78 in synchronization with a clock signal CK from the oscillation circuit 76.

The head driving circuit 71 is implemented in the driver IC 59. The head driving circuit 71 includes a shift register 81 for receiving a clock signal from the printer controller 70 and serial data SD that is the printing signal, a latch circuit 82 for latching a register value in the shift register 81 by using a latch signal LAT from the printer controller 70, a level converter circuit (level shifter) 83 for converting levels of the output value of the latch circuit 82, and an analog switch array (switch circuit) 84 in which on/off of the switch is controlled by the level shifter 83. The switch circuit 84 includes a switch array for receiving the driving waveform Pv from the driving waveform generation circuit 77 of the printer controller 70, and the switch circuit 84 is connected to the piezoelectric vibrators 52 each corresponding to a nozzle of the recording head (inkjet head).

The printing data SD that is serially transferred to the shift register 81 is latched by the latch circuit 82. The voltage of the latched printing data is increased to a predetermined voltage, several tens of volts, for example, by the level shifter, such that the switch in the switch circuit 84 can be driven. Then, the printing data is supplied to the switch circuit 84 that is a switch part.

The driving waveform Pv supplied from the driving waveform generation circuit 77 is applied to the input side of the switch circuit 84. In the output side of the switch circuit 84, the piezoelectric vibrators 52 that are pressure generation parts are connected. For example, while the printing data applied to the switch circuit 84 is "1", a driving signal P corresponding to the driving waveform Pv is applied to a corresponding piezoelectric vibrator 52, so that the piezoelectric vibrator 52 expands and contracts according to the driving signal P. On the other hand, while the printing data is "0", supply of the driving signal P to a corresponding piezoelectric vibrator 52 is interrupted.

In the following, embodiments of the head driving control apparatus of the present invention included in the inkjet recording apparatus will be described.

First, an operation of the head driving control apparatus according to a first embodiment of the present invention will be described with reference to FIG. 10. In the first embodiment of the present invention, an inkjet head including the piezoelectric vibrators 52 of which the piezoelectric constant is d33 is driven by the "pull and shoot" method, so that small ink droplets are formed. In this embodiment, the driving waveform generation circuit 77 generates and outputs a driving waveform Pv shown in FIG. 10, and the driving waveform Pv is applied to the piezoelectric vibrator 52 as a driving signal P via the switch circuit 84.

The voltage (pulse height) of the driving signal P is Vp, and the driving signal P includes a first waveform element (contraction signal) a, a second waveform element (contraction state holding signal) b, a third waveform element (expansion signal) c, a fourth waveform element (expansion state holding signal) d and a fifth waveform element (contraction signal) e. In the first waveform element a, the voltage of the driving signal rises from a minimum voltage level VL (or an offset potential) that has a potential difference of several volts from the GND level, and volume of the pressurizing chamber 46 is contracted (decreased) without discharging a droplet. In the second waveform element b, the contracted state of the volume of the pressurizing chamber 46 is kept until the meniscus moves toward the pressurizing chamber 46. In the third waveform element c, the volume of the pressurizing chamber is expanded. In the fourth waveform element d, the expanded state of the pressurizing chamber 46 is kept. In the fifth waveform element, the ink droplet is discharged by contracting the volume of the pressurizing chamber 46.

The driving waveform generation circuit 77 that generates such driving waveform Pv can be formed by using a discrete circuit. However, in this embodiment, the driving waveform generation circuit 77 is formed by a ROM that stores the pattern of the driving waveform and a D/A converter for converting digital data of the driving waveform read from the ROM into analog data.

When the driving signal P having the driving waveform Pv is applied to the piezoelectric vibrator 52 of the inkjet head, the contraction signal a is applied first, so that the piezoelectric vibrator 52 extends. As a result, the vibration plate 42 is deformed to the pressurizing chamber 46, so that the volume of the pressurizing chamber 46 decreases. At this time, since the rising time constant tr is set such that an ink droplet does not discharge, the ink droplet does not discharge by the contraction signal a. Next, the contracted state is held by applying the contraction state holding signal b, during which the meniscus moves toward the outside of the nozzle 45 first, and, after a while, the meniscus starts to move toward the pressurizing chamber 46. If pulling and discharging operation is performed while the meniscus is moving toward the outside of the nozzle 45, a desired small ink droplet (small ink) cannot be formed.

Thus, the expansion signal c is applied at the timing when the meniscus starts to move to the pressurizing chamber 46, so as to restore the piezoelectric vibrator 52 and to increase the volume of the pressurizing chamber 46. As a result, the meniscus is pulled to the pressurizing chamber 46. At this time, the timing of this pressure vibration of the pressurizing chamber 46 is adjusted by applying the expansion state holding signal d. After that, the piezoelectric vibrator 52 is extended again by applying the contraction signal e, so that the volume of the pressurizing chamber 46 is decreased (contracted). As a result, the ink droplet is discharged.

As mentioned above, by providing the driving waveform generation part that generates and outputs the driving waveform including the driving signal having first to fifth waveform elements, a voltage can be applied to the pressure generation part only when necessary. Thus, the time for applying voltage can be decreased and failure occurrence ratio of the element can be decreased, and reliability improves.

It is desirable that intermediate voltage is not set and the rise of the contraction signal a is started from the offset potential. Accordingly, stress (voltage×time) to the piezoelectric vibrator 52 can be as small as possible.

In addition, in this embodiment, the driving signal including the first to fifth waveform elements a-e is formed, and, thus, after the volume of the pressurizing chamber is contracted without discharging a droplet, the volume of the pressurizing chamber is expanded when the nozzle meniscus is pulled, and, then, the volume of the pressurizing chamber is decreased again, so that the droplet is discharged. However, for example, the fourth waveform element (expansion state holding signal) d can be omitted if the fourth waveform element d has no effect on the voltage vibration in the pressurizing chamber 46.

Next, a second embodiment of the head driving control apparatus of the present invention will be described with reference to FIG. 11. In this embodiment, a large ink droplet is discharged by applying a plurality of driving pulses continuously in one driving period, wherein each driving pulse is a so-called "push and shoot" pulse for discharging an ink droplet by contracting the volume of the pressurizing chamber.

Figure 11:
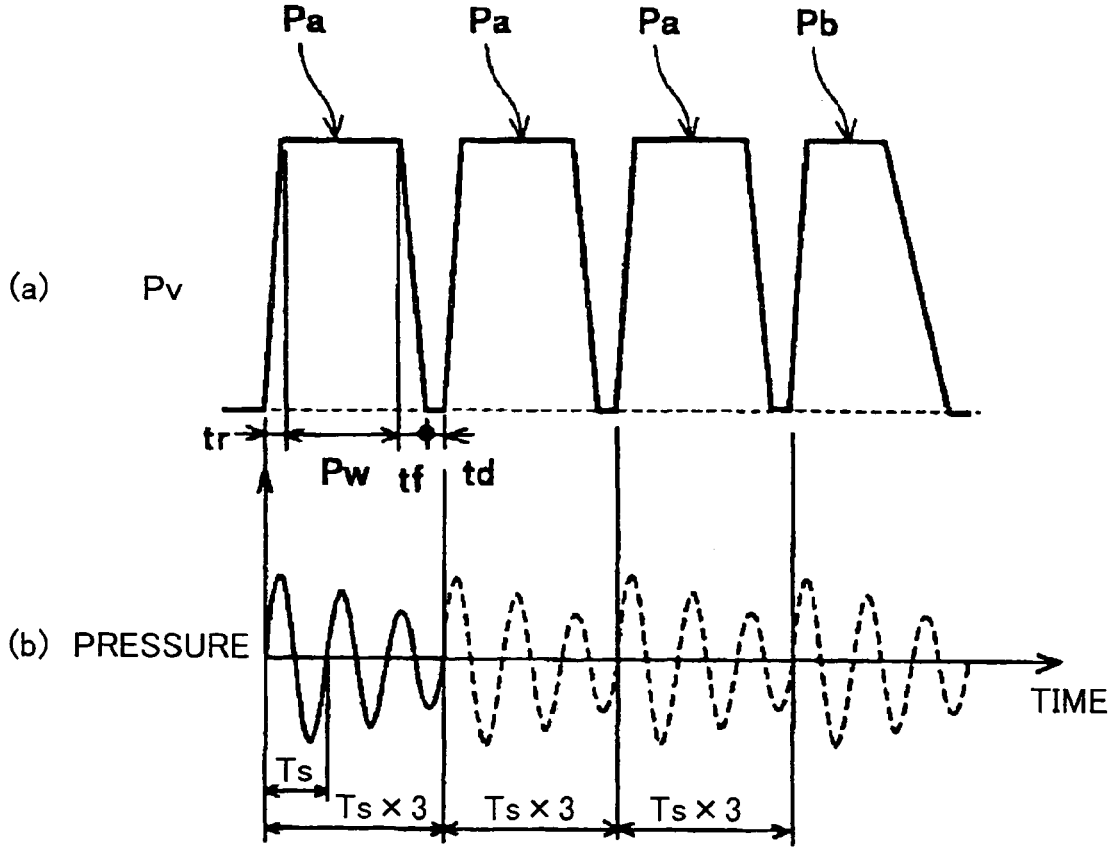
FIG. 11 show a driving signal and change of the pressure in the fluid chamber (pressurizing chamber) for explaining a second embodiment of the head driving control apparatus of the present invention.

In this embodiment, the driving waveform generation circuit 77 generates and outputs a driving waveform Pv including a plurality of driving pulses shown in FIG. 11(*a*), and this driving waveform Pv is applied to the piezoelectric vibrator 52 that is a pressure generation part via the switch circuit 84. That is, the driving waveform Pv is formed by time-series four pulses Pa and Pb each used for discharging an ink droplet by contracting the volume of the pressurizing chamber in a driving period. Difference between the driving pulse Pa and the driving pulse Pb is only the falling time constant tf.

By applying the driving waveform Pv to the piezoelectric vibrator 52 as the driving signal P, driving pulses Pa, Pb are applied to the piezoelectric vibrator 52 continuously. The piezoelectric vibrator 52 extends by the driving pulses Pa and Pb, so that the volume of the pressurizing chamber 46 is decreased via the vibration plate 42. Therefore, an ink droplet is discharged for each of the driving pulses Pa and Pb, and the four ink droplets are integrated while they are lying so as to form a large ink droplet, so that the large ink droplet is projected on a paper.

When the driving pulses are applied to discharge an ink droplet by contracting the volume of the pressurizing chamber 46, the pressure in the pressurizing chamber 46 changes as shown in FIG. 11(*b*). Assuming that wave parameters of the driving pulse Pa (Pb) are a rising time constant tr, a pulse width Pw, a falling time constant tf, and a pulse interval td, the waveform parameters are set such that a following equation (1) holds true, wherein Ts is the resonance period of the pressure vibration of the pressurizing chamber 46.

$$tr+Pw+tf+td=n\times Ts \quad (1)$$

(n is an integer that is no less than 1)

That is, the sum of the waveform parameters(=tr+Pw+tf+td) is set to be n times as large as the ink resonance period Ts. Accordingly, the timing for discharging an ink droplet (at the time of rise of each pulse) almost agrees with the timing when the pressure in the pressurizing chamber 46 becomes positive. Thus, the ink droplet discharging speed Vj can be increased, so that a plurality of ink droplets are integrated while flying with reliability to form a large droplet, and the large ink droplet can be projected on the paper.

In this case, n in the equation (1) is set to be 2 or 3. That is, it is desirable that the sum(=tr+Pw+tf+td) of the waveform parameters is set to be 2-3 times of the resonance period Ts. If n=1, the pressure change becomes large. Therefore, there is a possibility that discharge cannot be performed due to bubbles that are involved when the volume of the pressurizing chamber is expanded in the falling time constant tf after discharging is performed.

Next, the head driving control apparatus of the third embodiment of the present invention will be described with reference to FIG. 12. Also in this embodiment, a plurality of driving pulses are applied to form a large ink droplet.

Figure 12:
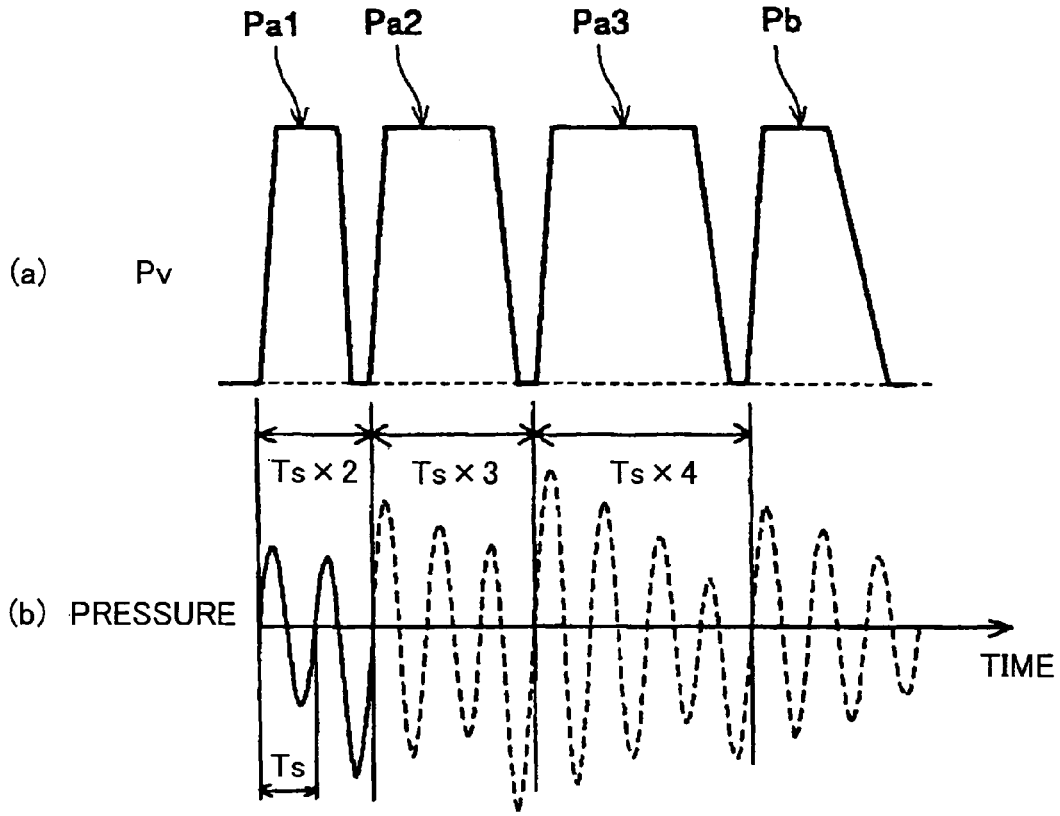
FIG. 12 show a driving signal and change of the pressure in the fluid chamber (pressurizing chamber) for explaining a third embodiment of the head driving control apparatus of the present invention.

In this embodiment, as shown in FIG. 12(*a*), each pulse width Pw2, Pw3 of second and third driving pulses Pa2, Pa3 is larger than the pulse width Pw1 of the first driving pulse Pa1 (Pw1<Pw2<Pw3). That is, the sum of the parameters for the driving pulse Pal is twice as large as Ts (n=2, Ts×2), the sum for the driving pulse Pa2 is three times as large as Ts (n=3, Ts×3), and the sum for the driving pulse Pa3 is four times as large as Ts (n=4, Ts×4).

Since the pressure in the pressurizing chamber increases as the driving pulse is applied repeatedly, pressure change becomes large if the same driving pulse is applied continuously. Therefore, there is a possibility that discharge cannot be performed since bubbles are involved when the volume of the pressurizing chamber is expanded in the falling time constant tf after discharging is performed.

Thus, each pulse width is set such that a pulse width of the next driving pulse is longer than that of the previous driving pulse, so that pressure change by the next driving pulse can be suppressed to be small and residual vibration becomes small. As a result, rising of pressure in the pressurizing chamber can be suppressed, and the possibility that discharge cannot be performed can be avoided. Especially, stability for discharging ink droplets improves when the head is driven by a high frequency.

Next, a relationship between the pulse width Pw in the driving pulse and the falling time constant tf will be described in the second and third embodiments.

Figure 13:
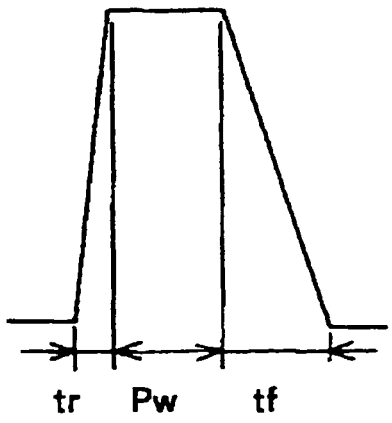
FIG. 13 is a figure for explaining parameters of a driving pulse in the third embodiment.
Figure 14:
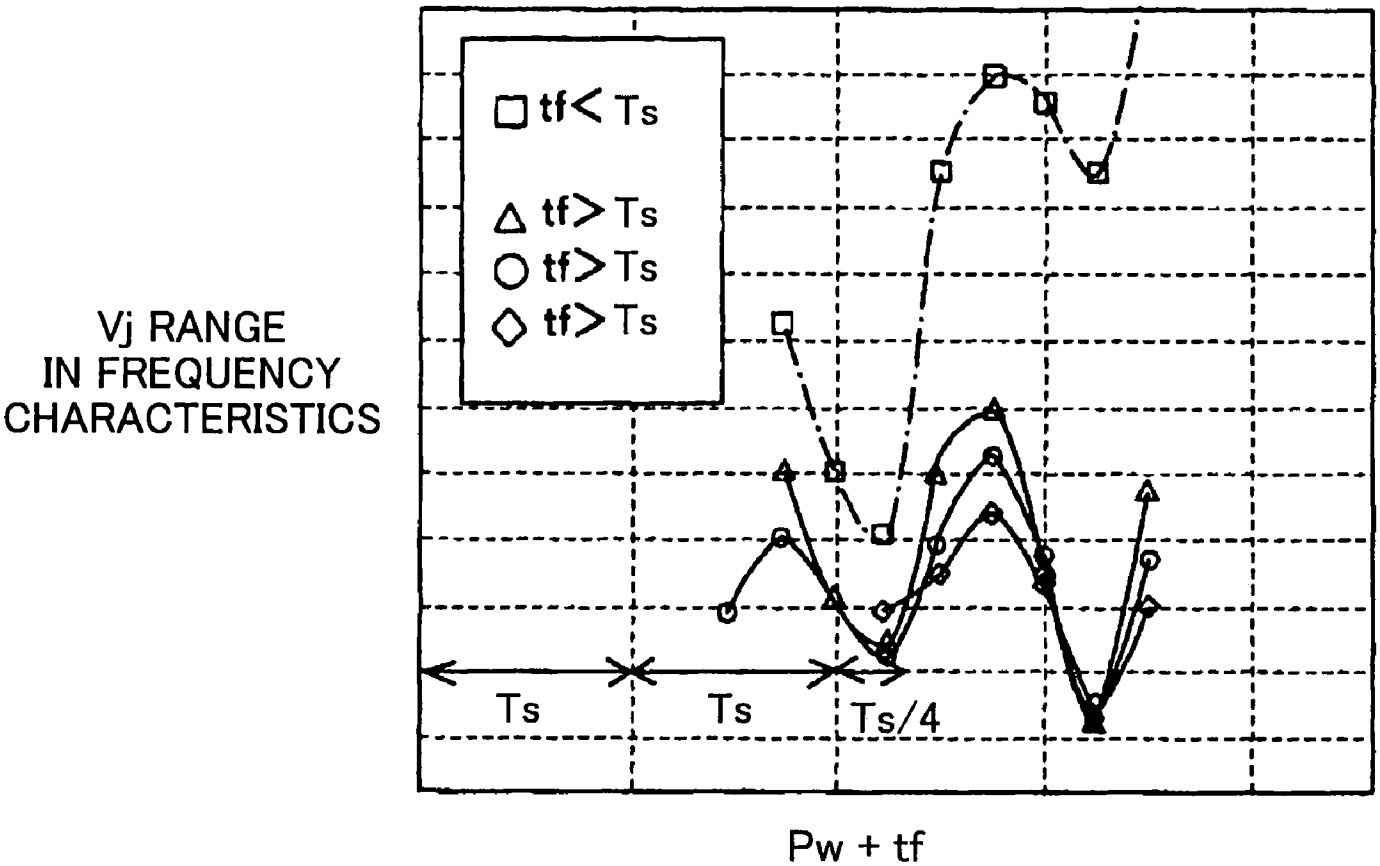
FIG. 14 shows a result of experiment for measuring change width (range) of ink droplet speed Vj with respect to "pulse width Pw+falling time constant tf"

As shown in FIG. 13, assuming that "pulse width Pw+falling time constant tf" are parameters of the driving pulse, a range (change width) of the ink droplet speed Vj in frequency characteristics is measured in each of two cases: one case is that the falling time constant tf is set to be greater than the resonance frequency Ts, and another case is that the falling time constant tf is set to be no greater than the resonance frequency Ts. FIG. 14 shows the result of the measurement.

Since the range of the ink droplet speed Vj is in proportion to the amplitude of the pressure vibration in the pressurizing chamber, it can be determined that the smaller the range of the ink droplet speed Vj is, the smaller the amplitude of the pressure vibration is. Therefore, according to the result of the measurement experiment, the range of the ink droplet speed Vj can be small by setting (Pw+tf) such that it satisfies the following equation (2).

$$Pw+tf=(n+1/4)\times Ts \quad (2)$$

(n is an integer that is no less than 1)

Accordingly, the residual vibration that occurs after ink discharge is performed by the last driving pulse can be suppressed efficiently. Especially, high frequency driving can be stably performed by setting Pw+tf in this way.

If the falling time constant tf is set to be no greater than the resonance frequency Ts, the range of the ink droplet speed Vj increases as (Pw+Tf) increases. Therefore, it is desirable to set Pw and tf such that tf>Ts is satisfied.

Next, a fourth embodiment of the head driving control apparatus of the present invention will be described with reference to FIGS. 15(*a*)-15(*e*). In this embodiment, a plurality of driving pulses are generated, and a desired waveform is obtained from the plurality of driving pulses. In this embodiment, the driving waveform generation circuit 77 generates and outputs six driving pulses (first to sixth pulses P1-P6) in one driving period as the driving waveform Pv.

In the first pulse P1, the waveform parameters are set such that the volume of the pressurizing chamber 46 is contracted, but the ink droplet is not discharged (for example, the rising time constant tr is set to be large). The first pulse P1 becomes a fourth driving signal Pvd for contracting the volume of the pressurizing chamber without discharging any ink droplet.

In each of the second to fifth pulses P2-P5, the waveform parameters are set such that the volume of the pressurizing chamber 46 is contracted so as to discharge an ink droplet. The second to fifth pulses P2-P5 forms a first driving signal Pva for discharging an ink droplet by contracting volume of the pressurizing chamber. In the second to fifth pulses P2-P5, the falling time constant tf of the fifth pulse P5 is set to be larger than that of any of the second to fourth pulses. Each of the second to fifth pulses P2-P5 is set such that the before-mentioned equation (1) is satisfied like the driving pulse of the second embodiment.

Also in the sixth pulse P6, the waveform parameters are set such that the volume of the pressurizing chamber 46 is contracted so as to discharge an ink droplet. The sixth pulse P6 is used to form a third driving signal Pvc which includes the waveform elements of the first to fifth pulses P1-p5 and the sixth pulse P6. The third driving signal is used for contracting the volume of the pressurizing chamber to discharge an ink droplet after expanding the volume of the pressurizing chamber.

Therefore, by selecting one or more pulses from the first to sixth pulses P1-P6 output from the driving waveform generation circuit 77 by using the switch circuit 84, a proper driving signal can be applied to the piezoelectric vibrator 52 according to the selection, so that a plurality of kinds of ink droplets having different sizes can be formed. FIG. 16 shows relationship between conditions ("0", "1") of printing data and the amount of discharged droplet Mj.

Figure 15:
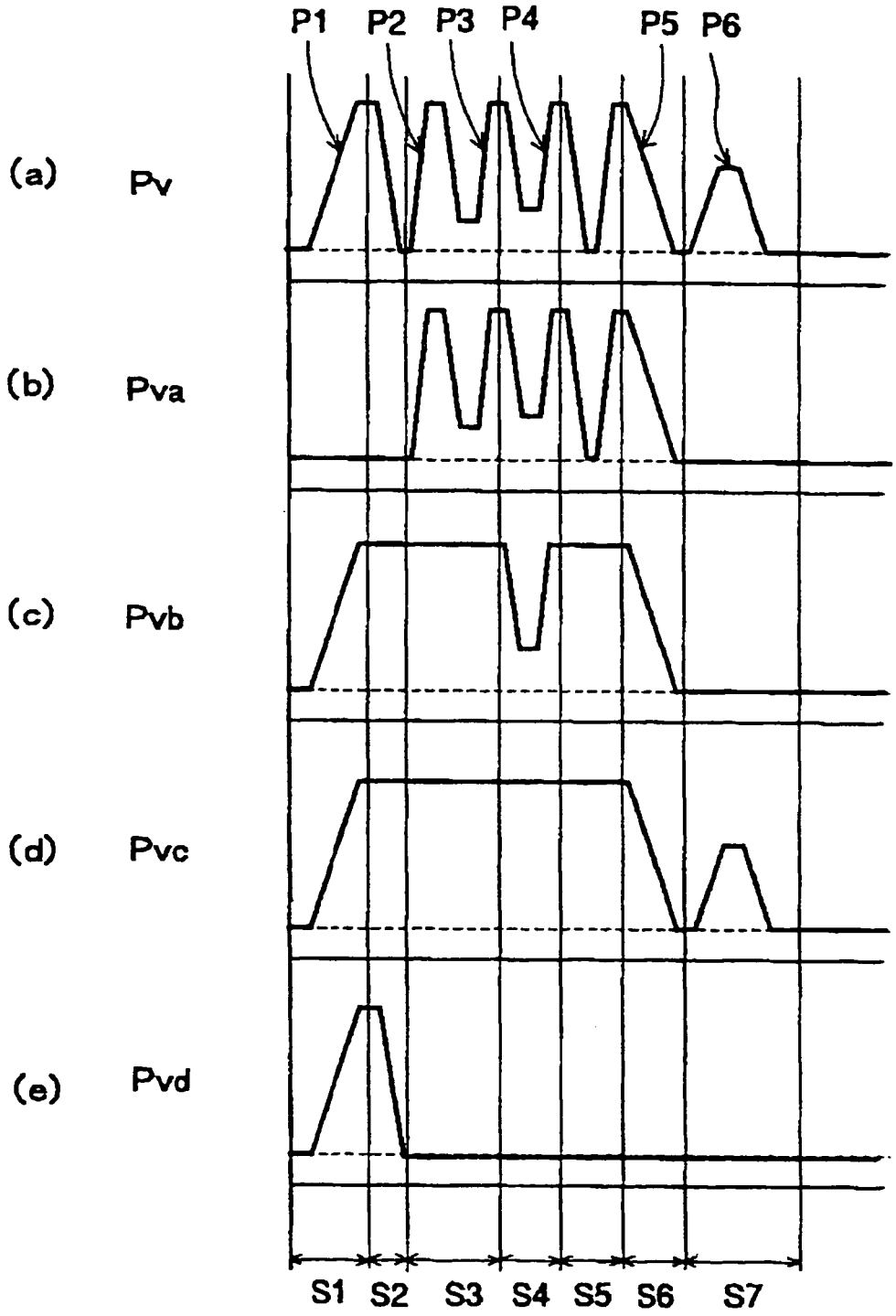
FIG. 15 shows a driving waveform and driving signals according to a fourth embodiment of the present invention.

That is as shown in the field of the non-discharge driving in FIG. 16, by setting printing data to be "1" to set the switch circuit 84 on only during the time S1, only the first pulse P1 is applied to the piezoelectric vibrator 52 as the fourth driving signal Pvd as shown in FIG. 15(*e*). Since the first pulse P1 that is the fourth driving pulse Pvd decreases the volume of the pressurizing chamber 46, but does not discharge an ink droplet, the meniscus only vibrates during the time.

Therefore, while printing is not performed, by selecting the fourth driving pulse Pvd in a plurality of driving periods, for example, each time when when main scanning direction of the inkjet head (recording head 14) is reversed, the ink meniscus can be vibrated several times. Thus, the viscosity of ink around the nozzle becoming high can be avoided, so that printing quality improves.

As shown in the field of Mj3 (small) in FIG. 16, the printing data is set to be "1" to set the switch circuit 84 on during the time S1, and, then, the printing data is set to "0" to set the switch circuit 84 off from the time S2 to the time S5. That is, the supply of the driving signal is shut off after the first pulse P1 is applied to the piezoelectric vibrator 52, and the charge applied by the first pulse P1 is held in the piezoelectric vibrator 52. After that, by setting the printing data to be "1" again during the time S6 and S7, the switching circuit 84 is set on. That is, the falling edge of the fifth pulse P5 and the sixth pulse P6 are applied to the piezoelectric vibrator 52. That is, the third driving signal Pvc shown in FIG. 15(*d*) is obtained.

Figure 10:
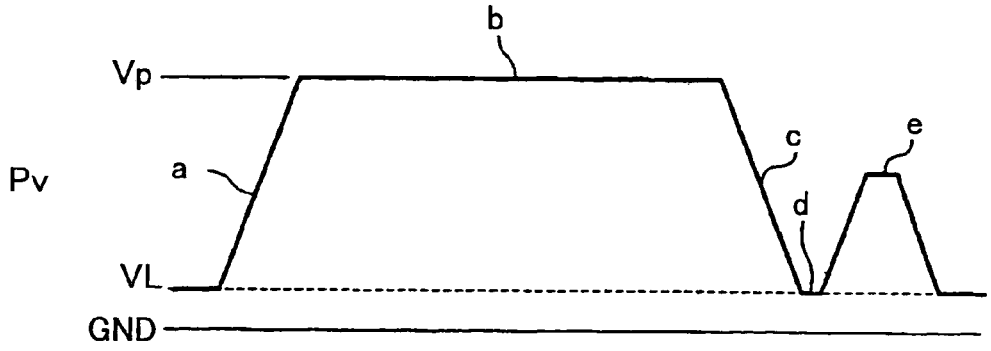
FIG. 10 is a figure for explaining the operation of the head driving control apparatus according to a first embodiment of the present invention.

Accordingly, like the case shown in FIG. 10, the second driving signal Pvc is applied to the piezoelectric vibrator 52, wherein the second driving signal Pvc includes the first waveform element (contraction signal) a, the second waveform element (contraction state holding signal) b, the third waveform element (expansion signal) c, the fourth waveform element (expansion state holding signal) d and the fifth waveform element (contraction signal) e. In the first waveform element a, the voltage of the driving pulse rises from a minimum voltage level VL (or an offset potential) that has a potential difference of several volts from the GND level, and volume of the pressurizing chamber 46 is contracted (decreased) without discharging a droplet. In the second waveform element b, contraction of the volume of the pressurizing chamber 46 is kept until nozzle meniscus moves toward the pressurizing chamber 46. In the third waveform element c, the volume of the pressurizing chamber is expanded. In the fourth waveform element d, the expanded state of the pressurizing chamber 46 is kept. In the fifth waveform element, the ink droplet is discharged by contracting the volume of the pressurizing chamber 46.

Therefore, a small ink droplet (small ink droplet) can be formed in the same way as in the first embodiment in this case.

In addition, as shown in the field of Mj1 (large), by setting printing data to be "0" to set the switch circuit 84 off from the time S1 to the time S2, and by setting printing data to be "1" from the time S3 to the time S6 and setting the printing data to be "0" again in S7, each of the second to fifth pulses P2-P5 is applied to the piezoelectric vibrator 52 as the first driving signal Pva as shown in FIG. 15(*b*), each of which second to fifth pulses P2-P5 is for discharging an ink droplet by contracting the pressurizing chamber 46.

Therefore, in the same way as the before-mentioned second embodiment, since a plurality of ink droplets are discharged continuously and they are integrated while flying, a very large ink droplet can be formed.

In this case, in order to perform push and shoot driving, the waveform is set such that an ink droplet is discharged on the rising edge of the second pulse P2. On the other hand, as mentioned before, the first pulse P1 is necessary for realizing a small ink droplet by using the pull and shoot method, in which the first pulse P1 becomes a predetermined voltage without discharging an ink droplet. That is, the first pulse P1 is used not only for ink meniscus vibration but also for selecting between discharging the small ink droplet and the large ink droplet.

In addition, as shown in the field of Mj2 (medium) of FIG. 16, by setting the printing data to be "1" during the time S1 and by setting the printing data to be "0" from the time S2 to the time S3, supply of the driving signal is shut off after the first pulse P1 is applied to the piezoelectric vibrator 52, and charge accumulated by the first pulse P1 is held in the piezoelectric vibrator 52. Then, by setting the printing data to be "1" during the time S4 and by setting the printing data to be "0" during the time S5, supply of the driving signal is shut off after the fourth pulse P4 is applied to the piezoelectric vibrator 52, and the charge applied by the fourth pulse P4 is held in the piezoelectric vibrator 52. After that, the printing data is set to be "1" again during the time S6, so that the falling edge of the fifth pulse P5 is applied to the piezoelectric vibrator 52. In addition, the printing data is set to "0" in the time S7. As a result, the second driving signal Pvb shown in FIG. 15(*c*) is obtained and applied to the piezoelectric vibrator 52.

In this case, waveform elements of the first pulse P1 to the fifth pulse P5 are connected, so that the first driving pulse Pvb is applied to the piezoelectric vibrator 52. As a result, a medium size ink droplet can be formed. In this case, it is important that the rising edge of the last pulse (fifth pulse P5) is not included. That is, if an waveform is formed for realizing the medium ink droplet by using pluses from the second pulse P2 to the fifth pulse P5, there is a possibility that discharge speed of ink that is finally discharged becomes small and the ink droplets do not merge into one ink droplet. Thus, for forming the medium ink droplet, the driving condition is set by using waveform elements of the second to fourth pulses P2-P4. As a result, the waveform of the fifth pulse P5 can be determined irrespective of the driving condition for forming the medium ink droplet.

As shown in FIG. 15(*a*), by setting voltages (pulse height values) of the first to fifth pulses P1-P5 to be the same, the pulses can be smoothly connected, and stresses applied on the driving IC such as rush current can be avoided.

Next, the fifth embodiment of the head driving control apparatus of the present invention will be described with reference to FIG. 17. Also in this embodiment, a plurality of driving pulses are generated and output, and a driving pulse having a desired waveform is obtained from the plurality of driving pulses.

In this embodiment, the driving waveform generation circuit 77 generates seven driving pulses of first to seventh pulses P1-P7 in one driving period as a driving waveform Pv.

The first to sixth pulses P1-P6 are the same as those of the fourth embodiment. As for the seventh pulse P7, the waveform parameters are set such that the volume of the pressurizing chamber 46 is contracted without discharging an ink droplet (for example, the voltage value (pulse height) of P7 is set to be small). The seventh pulse P7 forms a fifth driving signal Pve for contracting the volume of the pressurizing chamber 46 without discharging an ink droplet. FIG. 18 shows conditions ("0", "1") of printing data applied to the switch circuit 84, under which conditions ink droplets having different sizes are formed or meniscus vibration is performed. That is, FIG. 18 shows selection conditions of the plurality of pulses P1-P7 forming the driving waveform Pv.

Figure 17:
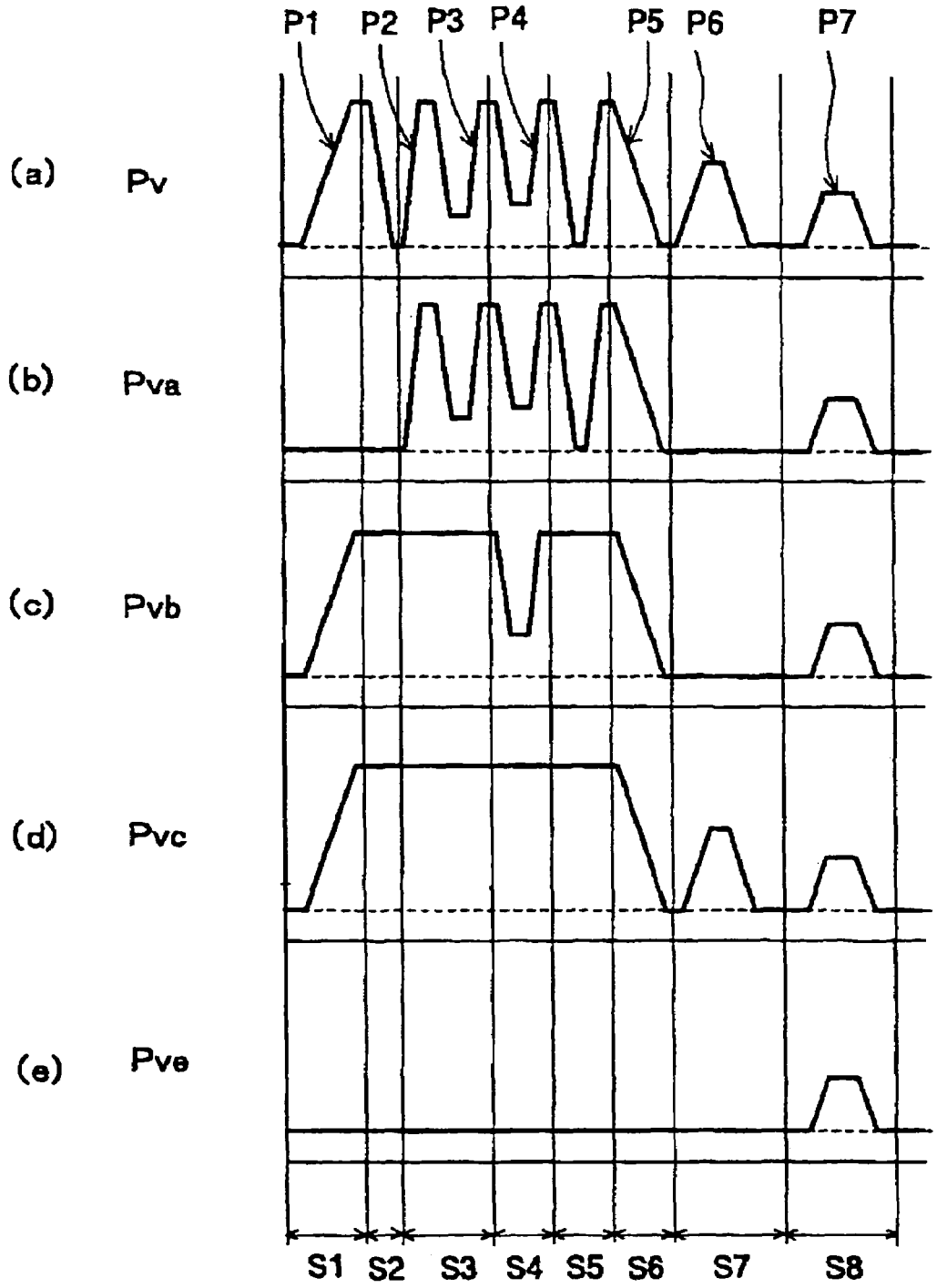
FIG. 17 shows a driving waveform and driving signals according to a fifth embodiment of the present invention.

As shown in the field of non-discharge driving in FIG. 18, by setting the printing data to be "1" only during the time S8, the seventh pulse P7 is applied to the piezoelectric vibrator 52 as the fifth driving signal Pve as shown in FIG. 17(*e*). The object for applying the fifth driving signal Pve is to improve the quality of printing by applying vibration several times so as to avoid that viscosity of ink around the nozzle becomes high. Since the first pulse P1 forms a part of waveform elements of the second driving signal Pvb and the third driving signal Pvc, the pulse height of the first pulse P1 should be as large as necessary for discharging an ink droplet like the other pulses (the rising time constant tr of P1 is set such that the ink droplet is not discharged). Thus, if ink is slightly vibrated by using the first pulse P1 as the fourth driving signal Pvd as mentioned before, the volume of the pressurizing chamber is largely contracted, so that printing quality may be degraded since ink may leak due to disturbance and the like.

Therefore, by using the seventh pulse P7 in which the pulse height (voltage value) is small and ink discharge is not performed to slightly vibrate the ink, the volume of the pressurizing chamber 46 is not largely contracted, and the printing quality degrading by ink leakage due to disturbance can be avoided.

As shown in each field of FIG. 18, the printing data is set to be "1" during the time S8. Thus, as shown in FIGS. 17(*b*)-17(*d*), the seventh pulse P7 is selected irrespective of the kind of the driving signal to be applied. In other words, the fifth driving signal Pve obtained from the seventh pulse P7 is applied every time period in printing. Thus, the effect of avoiding that viscosity of the ink around nozzle becomes high further increases.

When forming a small ink droplet (Mj3), by setting the printing data to be "1" during the time S1 and during the time S6 and during the time S7, the third driving signal Pvc the same as that shown in FIG. 15(*d*) can be obtained as shown in FIG. 17(*d*), so that a small droplet can be formed by discharging an ink droplet by the sixth pulse P6.

When forming a large ink droplet (Mj1), by setting the printing data to "1" in S3, S4, S5 and S6, the first driving signal Pva the same as that in FIG. 15(*b*) can be obtained as shown in FIG. 17(*b*). In this case, ink droplets discharged by the second to fifth pulses P2-P5 are integrated while flying. Further, when a medium ink droplet is formed (Mj2), the printing data is set to be "1" in S1, S4 and S6. Accordingly, as shown in FIG. 17(*c*), the second driving signal Pvb the same as that shown in FIG. 15(*c*) is obtained and an ink droplet is discharged at the fourth pulse P4.

Next, examples on setting the pulse height of driving pulses for contracting the pressurizing chamber 46 will be described with reference to FIG. 19.

Figure 19:
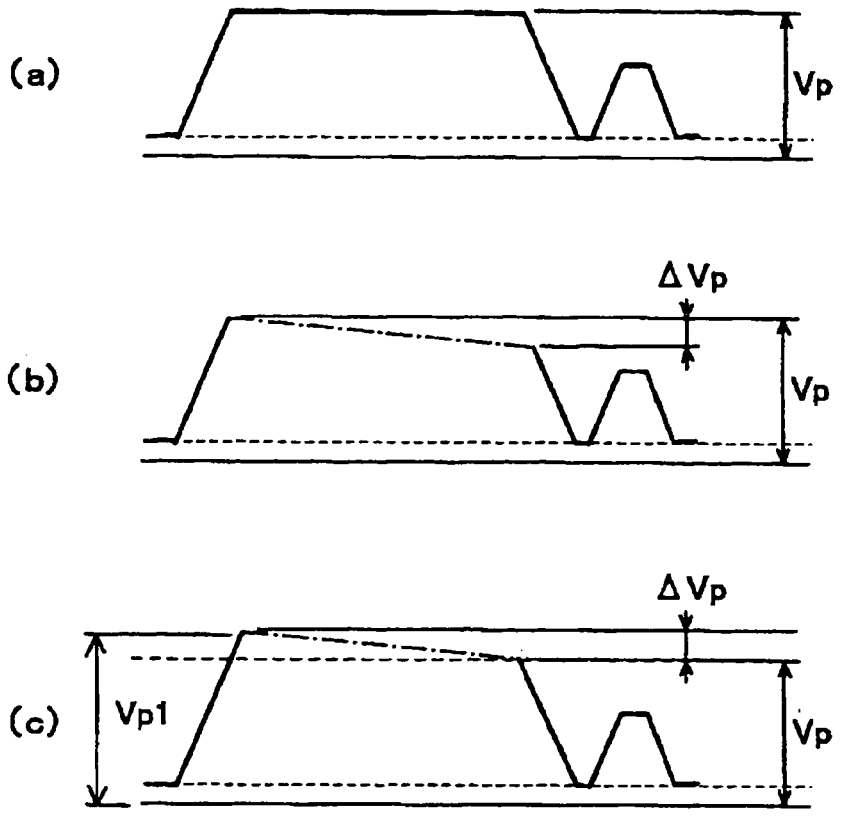
FIG. 19 shows an example for setting pulse height of a driving pulse for contracting the pressurizing chamber.

As shown in FIG. 19(*a*), when generating a driving signal as described in FIG. 10, FIG. 15(*d*) and FIG. 17(*d*), the voltage (pulse height) of the first waveform element a is set to a voltage Vp. However, the charge held by the piezoelectric vibrator 52 is discharged little by little. As a result, as shown in FIG. 19(*b*), a voltage drop ΔVp occurs in the contracted state.

The voltage drop ΔVp acts for expanding the volume of the pressurizing chamber 46. As a result, the size of the ink droplet may change. Thus, as shown in FIG. 19(*c*), the pulse height of the driving pulse is set to a voltage value Vp1 in which a voltage corresponding to the voltage drop ΔVp is added. Therefore, the necessary voltage value Vp can be obtained at the time when the state moves from the contract holding state to the expanding state, so that a small ink droplet can be discharged stably.

Figure 20:
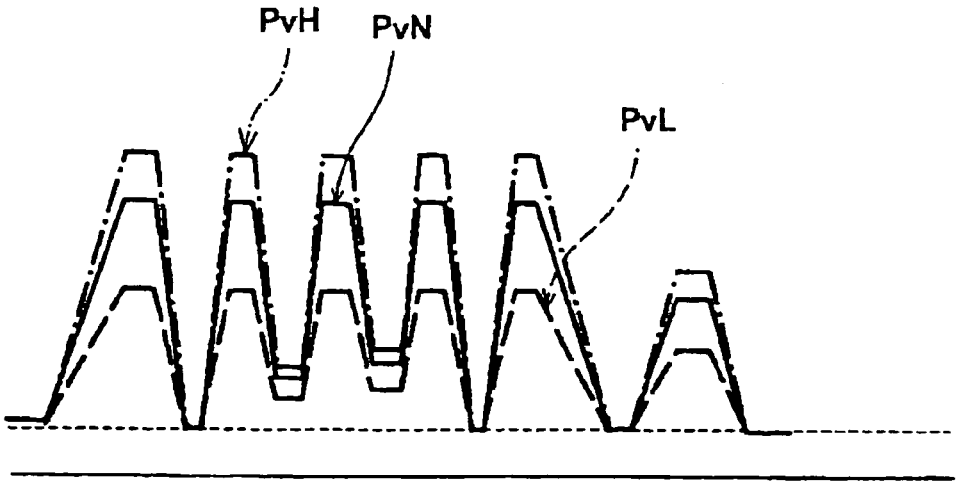
FIG. 20 is a figure for explaining temperature compensation for the driving waveform.

Next, temperature compensation will be described with reference to FIG. 20. Characteristics of ink change as environmental temperature changes. Thus, the size of the ink droplet changes according to the temperatures even when voltages of driving pulses are the same for each temperature. Thus, the driving waveform generation circuit 77 stores a plurality of driving waveform patterns corresponding to temperatures, and a proper driving waveform is selected according to a temperature detected by a temperature censor 80.

For example, a driving waveform PvH for a low temperature, a driving waveform PvL for a high temperature and a driving waveform PvN for an ordinary temperature are stored beforehand, and one of them is selected according to a detected environmental temperature, wherein the voltage Vp is large in the driving waveform PvH for the low temperature, the voltage Vp is low in the driving waveform PvL for the high temperature. Accordingly, as shown in FIG. 20, for example, since one of the driving waveforms can be selected and output among three kinds of driving waveforms, an ink droplet having a proper ink droplet speed and a proper ink droplet size can be discharged stably.

Although the piezoelectric vibrator 52 is assumed to be PZT of d33 direction deformation in the above-mentioned embodiments, PZT of the deflection vibration type can be used. However, the PZT of d33 direction deformation has higher reliability, so that failure ratio can be reduced to lower than that of other PZTs.

In the above-mentioned embodiments, the inkjet recording apparatus is used as an image recording apparatus, including an inkjet head for discharging an ink droplet. However, the present invention can be applied to an image recording apparatus including a fluid discharging head for discharging a fluid droplet other than ink, such as fluid resists for patterning and a gene analyzing sample.

As mentioned above, according to the head driving control apparatus of the above-mentioned embodiments, the driving waveform generation part outputs a driving signal including: a first waveform element for contracting volume of the pressurizing chamber without discharging a droplet; a second waveform element for keeping a contracted state in which volume of the pressurizing chamber is contracted until a meniscus in the nozzle moves toward the pressurizing chamber; a third waveform element for expanding volume of the pressurizing chamber from the contracted state; a fourth waveform element for keeping an expanded state of volume of the pressurizing chamber; and a fifth waveform element for contracting volume of the pressurizing chamber from the expanded state to discharge a droplet. Therefore, the driving voltage can be applied only when printing is performed. Thus, the time for applying voltage on the pressure generation part can be shortened, so that reliability increases.

In the head driving control apparatus, voltage of the first waveform element starts to change from an offset voltage. Thus, the voltage applied to the pressure generation part can be suppressed low when printing is not performed.

In addition, the above-mentioned image recording apparatus includes a part for outputting a driving signal that includes time-series driving pulses each for contracting the volume of the pressurizing chamber to discharge a droplet in a driving period; wherein parameters for each of the driving pulses are determined such that an equation $tr+Pw+tf+td=n\times Ts$ holds true, wherein tr is a rising time constant, Pw is a pulse width, tf is a falling time constant, td is a pulse interval, Ts is a resonance frequency of the pressure in the pressurizing chamber, and n is an integer no less than 1. Accordingly, a large droplets can be formed. "n" in the equation can be set as 2 or 3, so that a stable discharge can be realized. In addition, as for adjacent two driving pulses with respect to time in the time-series driving pulses, n in the equation for a driving pulse is greater than n for a previous driving pulse. Accordingly, increase of residual vibration can be suppressed, so that high frequency driving can be performed stably.

By determined the last driving pulse in the time-series driving pulses such that an equation $Pw+tf=(n+1/4)\times Ts$ holds true, increase of residual vibration by the last driving pulse can be suppressed, so that high frequency driving can be performed stably. In this case, by setting tf to be greater than Ts, increase of residual vibration by the last driving pulse can be suppressed with more reliability.

In addition, according to the above-mentioned embodiments, the image recording apparatus includes: a part for outputting a driving waveform including a plurality of time-series driving pulses in a driving period; and a part for selectively applying at least a first signal and a second signal to the pressure generation part, wherein each of the first and second signals is obtained from the driving waveform; and wherein: the first signal includes driving pulses each of which contracts the volume of the pressurizing chamber to discharge a droplet; the second signal includes a waveform element for contracting volume of the pressurizing chamber to discharge a droplet after expanding the volume of the pressurizing chamber.

According to this image recording apparatus, the "push and shoot" driving and the "pull and shoot" driving can be mixed, so that selection range for droplet amount can be increased.

In the image recording apparatus, a first pulse in the time-series driving pulses is used for contracting the volume of the pressurizing chamber without discharging a droplet. Accordingly, the "pull and shoot" can be performed stably.

In the image recording apparatus, the part for selectively applying further selectively applies a third signal formed from the driving waveform, wherein the third signal includes waveform elements of driving pulses for the first signal and of a pulse for contracting the volume of the pressurizing chamber without discharging a droplet, in which a droplet is discharged by using a driving pulse other than the last driving pulse in the driving pulses for the first signal. Accordingly, a medium size droplet can be stably formed. In addition, by applying the first pulse to the pressure generation part while printing is not performed, reliability can be improved.

In the above-mentioned image recording apparatus, the pulse height of the first waveform element is set such that a voltage drop occurring during the time of the second waveform element is added. Accordingly, variation of droplets decreases. In addition, in the image recording apparatus, the second signal includes waveform elements of the driving pulses for the first signal which driving pulses have the same pulse height. Accordingly, pull and shoot driving can be performed stably. In addition, by including a driving pulse for contracting the volume of the pressurizing chamber without discharging a droplet, wherein the pulse height of the driving pulse is smaller than that of other driving pulses for discharging a droplet, it can be avoided that viscosity of ink around nozzle becomes high, so that reliability increases. By applying the driving pulse in each cycle of printing, it can be avoided that viscosity of ink around nozzle becomes high more efficiently. In addition, by changing pulse height in the driving waveform according to environmental temperature, stable ink discharge can be realized.

In the following, sixth and seventh embodiments of the present invention corresponding to the second object will be described with reference to figures. In the following, the sixth embodiment will be described.

Figure 21:
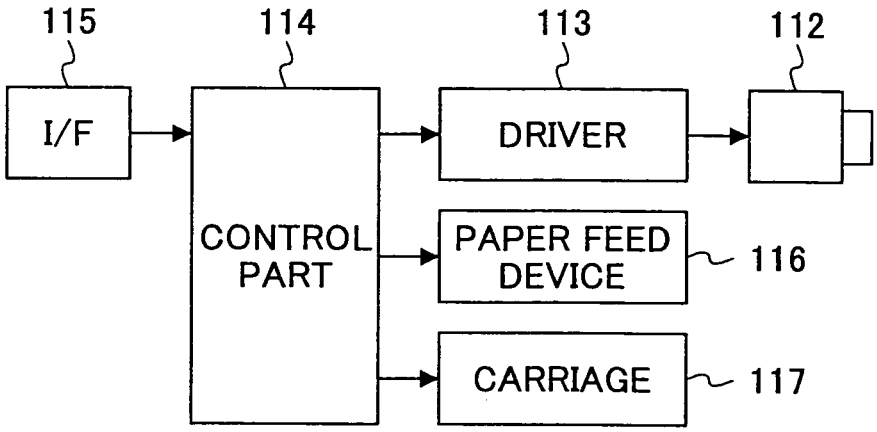
FIG. 21 is a schematic block diagram of an inkjet printer as an example of the image recording apparatus of the present invention according to the sixth embodiment.

FIG. 21 is a schematic block diagram of an inkjet printer 111 as an example of the image recording apparatus of the present invention according to the sixth embodiment. As shown in FIG. 21, the inkjet printer 111 includes an inkjet head 112 as a droplet discharging head, a driver 113, a control part 114, an interface 115, a paper feed apparatus 116 and a carriage 117. The driver 113 applies a driving voltage to a piezoelectric vibrator 102 (shown in FIG. 22) in the inkjet head 112. The control part 114 includes a microcomputer and the like and controls the whole of the inkjet printer 11. The interface 115 receives printing data 112 from the outside for performing printing by using the inkjet head. The paper feed apparatus 116 feeds a paper that is a recording medium for printing in a direction of sub-scanning by using a paper feed motor and a paper feed roller that are not shown in the figure. The carriage 117 mounts the inkjet head 112 and moves in a main scanning direction.

Figure 22:
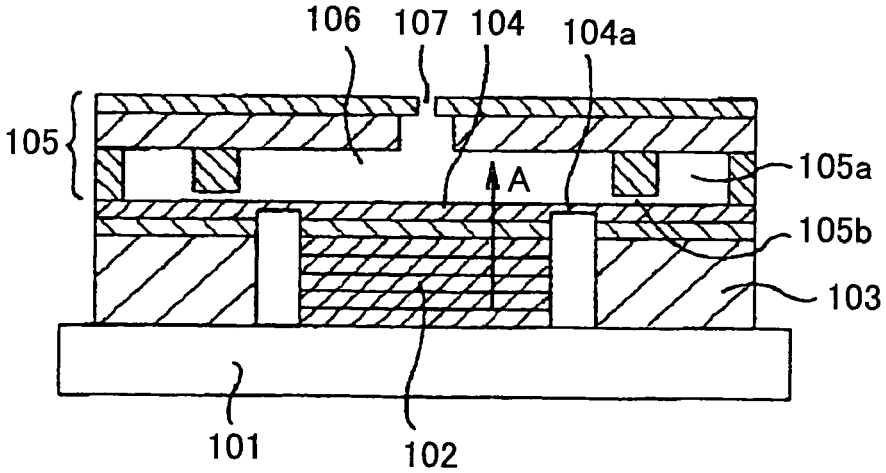
FIG. 22 shows a longitudinal section of the inkjet head according to the sixth embodiment.

FIG. 22 shows a longitudinal section of the inkjet head 112 according to the sixth embodiment. The inkjet head 112 includes a substrate 101, a piezoelectric vibrator 102 that is an actuator of the inkjet head 112, a frame 103 for supporting an ink common fluid chamber 105*a,* a vibration plate 104, a fluid chamber and channel 105, the ink common fluid chamber 105*a,* a fluid resistance part 105*b,* an ink pressure chamber 106 (the ink pressure chamber may be called a pressurizing chamber), and a nozzle 107 that is connected to the ink pressure chamber 106 and that discharges ink.

The vibration plate 104 is provided with diaphragm parts 104*a* in the sides of the ink pressure chamber 106, the diaphragm parts 104*a* being capable of elastic deformation. The vibration plate 104 can contract and expand the ink pressure chamber 106 by expanding and contracting the piezoelectric vibrator 102. When a driving signal is applied from the driver 113 to the piezoelectric vibrator 102, the piezoelectric vibrator 102 expands in the direction of the arrow A in FIG. 22. When the charged piezoelectric vibrator 102 is discharged, the piezoelectric vibrator 102 contracts in an direction opposite to the direction of the arrow A.

Figure 23:
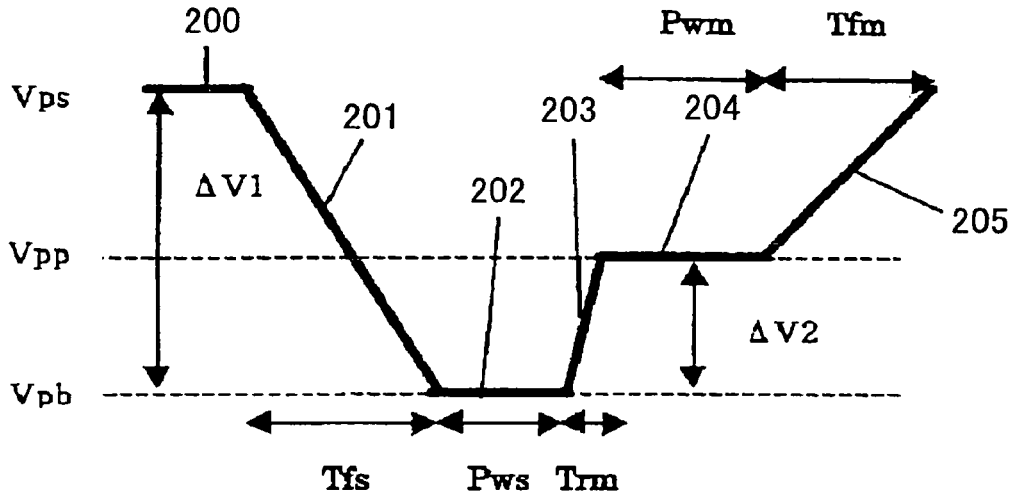
FIG. 23 shows a waveform diagram showing a waveform of the driving signal applied to the inkjet head for forming a small dot.

The driver 113 is controlled by the control part 114, and applies a driving signal, as described as follows, to the inkjet head 112 so that the inkjet head 112 forms ink droplets. FIG. 23 shows a waveform diagram showing a waveform of the driving signal applied to the inkjet head 112 for forming a small dot. In one period of the driving signal, the voltage descends at a constant gradient from the first highest voltage Vps (holding pulse 200) to the lowest voltage Vpb (first waveform element:discharge pulse 201), wherein the gradient is represented as (Vps−Vpb)/Tfs which is constant and Tfs indicates a time for applying the first waveform element. Next, the first lowest voltage Vpb is held for a predetermined time (second waveform element:holding pulse 202:pulse width Pws). Then, the voltage ascends at a constant gradient from the first lowest voltage Vpb to the second highest voltage Vpp (third waveform element:charge pulse 203), wherein the gradient is represented as (Vpp−Vpb)/Trm which is constant and Trm indicates a time of applying the third waveform element. After that, the second highest voltage Vpp is held for a predetermined time (fourth waveform element:pulse 204 (pulse width Pwm)). After that, the voltage ascends (fifth waveform element:charge pulse 205) to the first highest voltage Vps at a constant gradient so as to continue to a driving signal of a next cycle, wherein the gradient is represented as (Vps−Vpp)/Tfm which is constant and Tfm is a time for applying the fifth waveform element.

Next, operation of the inkjet head 112 when such driving signal is applied will be described. In a state where the holding pulse 200 is applied to the piezoelectric vibrator 102, the piezoelectric vibrator 102 bends in the direction of the arrow A so that volume of the ink pressure chamber 106 contracts. Next, when the discharge pulse 201 is applied, the piezoelectric vibrator 102 bends in the opposite direction of the arrow A, so that the volume of the ink pressure chamber 106 expands, and negative pressure occurs in the inside of the ink pressure chamber 106. As a result, the meniscus of ink is largely pulled from the aperture of the nozzle 107 toward the ink pressure chamber 106. Then, while the holding pulse 202 is applied after the discharge pulse 201 is applied, the voltage Vpb is held. However, the pressure occurring in the inside of the ink pressure chamber 106 performs damped vibration while repeating positive pressure and negative pressure at a period Ts that are determined by the structure of the ink pressure chamber 106, the diameter of the nozzle 107, fluid resistance and the like.

Next, when the discharge pulse 203 is applied, the piezoelectric vibrator 102 bends in the direction of the arrow A so that volume of the ink pressure chamber 106 is contracted and positive pressure occurs in the inside of the ink pressure chamber 106. At this time, since the meniscus is largely pulled from the aperture of the nozzle 107, the amount of ink filled in the inside of the nozzle 107 is small. Therefore, in such a state, a small amount of ink is discharged by a total pressure of the positive pressure of the charge pulse 103 and the pressure vibrating at the period Ts.

Figure 24:
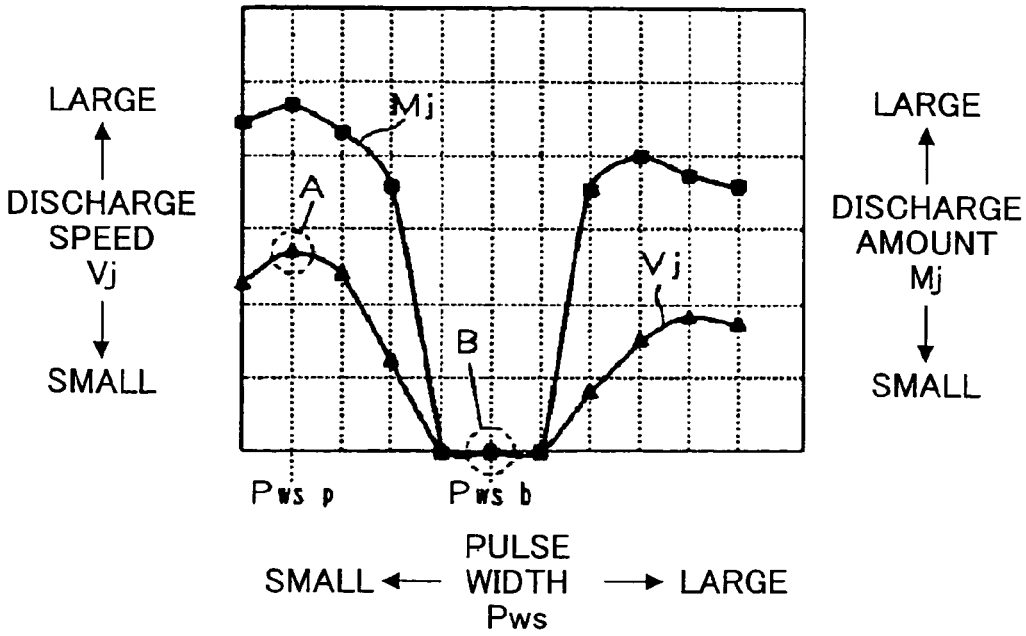
FIG. 24 shows a result of evaluation of the ink discharge speed Vj and the ink discharge amount Mj while changing the pulse width Pws.

Next, FIG. 24 shows a result of evaluation of the ink discharge speed Vj and the ink discharge amount Mj while changing the pulse width Pws. In the evaluation, the driving signal of FIG. 23 is applied to the inkjet head 112, setting the driving voltage Vpp as 20V. As shown in FIG. 24, the ink discharge speed Vj and ink discharge amount Mj change with periodicity according to the pulse width Pws.

Figure 25:
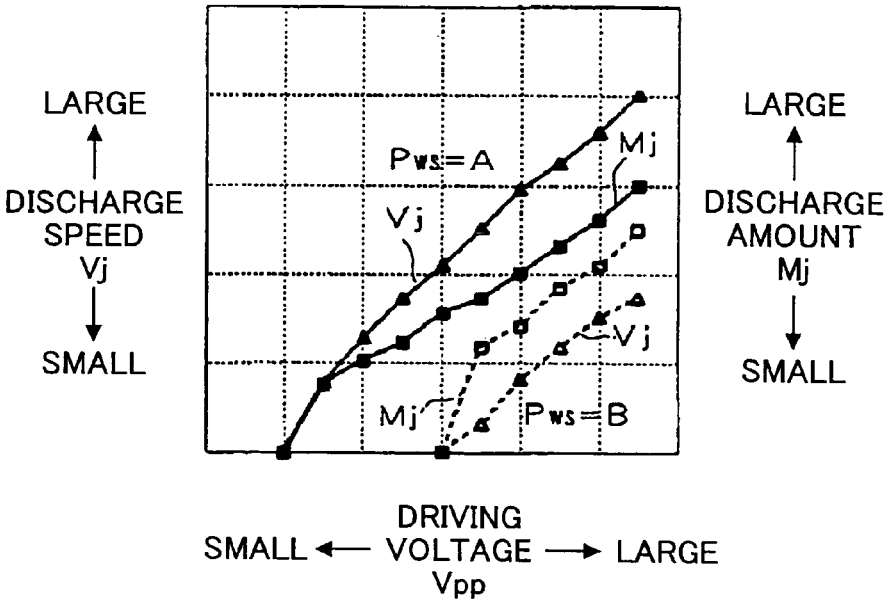
FIG. 25 shows a result of evaluation of dependence on the driving voltage Vpp (discharge voltage) for discharge speed.

FIG. 25 shows a result of evaluation of dependence on the driving voltage Vpp (discharge voltage), wherein two pulse widths (peak pulse width Pws p and bottom pulse width Pws b) are selected for this evaluation at which two pulse widths the ink discharge speed Vj and ink discharge amount Mj become maximum (A point) or minimum (B point). FIG. 25 indicates that, when the pulse width is the bottom pulse width Pws b by which the ink discharge speed Vj and ink discharging amount Mj become minimum (B point), the ink discharge speed Vj and ink discharge amount Mj do not become very large as discharge voltage increases. On the other hand, when the pulse width is the peak pulse width Pws p by which the ink discharge speed Vj and ink discharge amount Mj become maximum (A point), and the values of the ink discharge speed Vj and ink discharge amount Mj are even when the discharge voltage is small.

In the case of the driving signal shown in FIG. 23, as shown in FIG. 24, the ink discharge speed Vj and ink discharge amount Mj repeat increasing and decreasing at a period almost the same as the period Ts of the pressure vibration of the inside of the ink pressure chamber 106. Therefore, if the pulse width Pws of the second waveform element is set such that the charge pulse 203 starts to be applied at a timing when the pressure in the ink pressure chamber 106 becomes positive, the ink discharge speed becomes maximum. In addition, the ink discharge amount becomes maximum at the timing.

Thus, if the peak pulse width Pws p is selected as. the pulse width Pws of the second waveform element, a large margin can be obtained for ink discharge, so that the height of the charge pulse can be small. Therefore, the driving signal optimal for small dots can be obtained.

Figure 30:
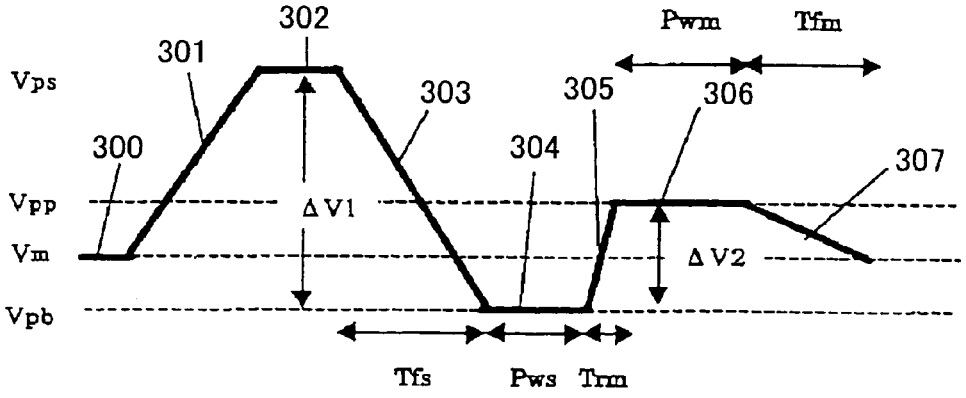
FIG. 30 shows an example of a driving waveform of a conventional inkjet printer.

FIG. 30 shows an example of a pulse waveform of a driving voltage of an inkjet head used in a conventional inkjet printer. Since a medium voltage Vm is set in the conventional driving voltage, each of the start and end of the driving voltage becomes the medium voltage Vm as shown in FIG. 30. On the other hand, as for the pulse waveform of the driving voltage of this embodiment shown in FIG. 23, there is no medium voltage, and the first maximum voltage Vps is set as a medium voltage. Compared with the waveform of the present invention, the charge pulse 301 and the holding pulse 302 are added in the pulse waveform of the driving voltage according to the conventional technology.

Therefore, the number of changes of the signal in a period is eight for the conventional technology shown in FIG. 30. On the other hand, the number of that of the present embodiment shown in FIG. 23 is six. Further, since ink discharge must not occur in the charge pulse 301 in the conventional example, the time for applying needs to be long. Therefore, frequency characteristics can be improved by this embodiment compared with the conventional example.

Figure 26:
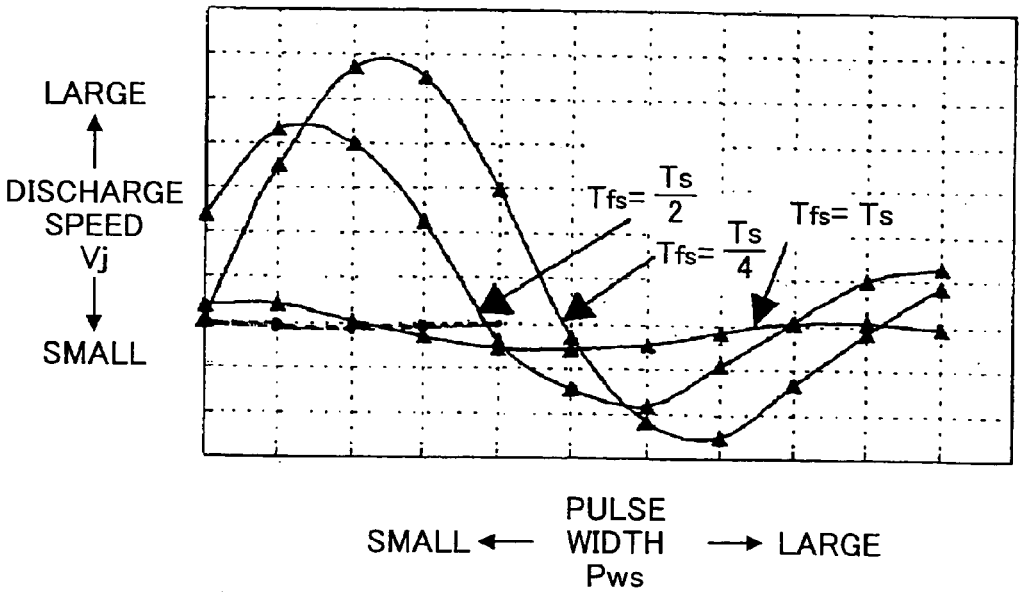
FIG. 26 shows dependency on the pulse width Pws for the ink discharge speed Vj.
Figure 27:
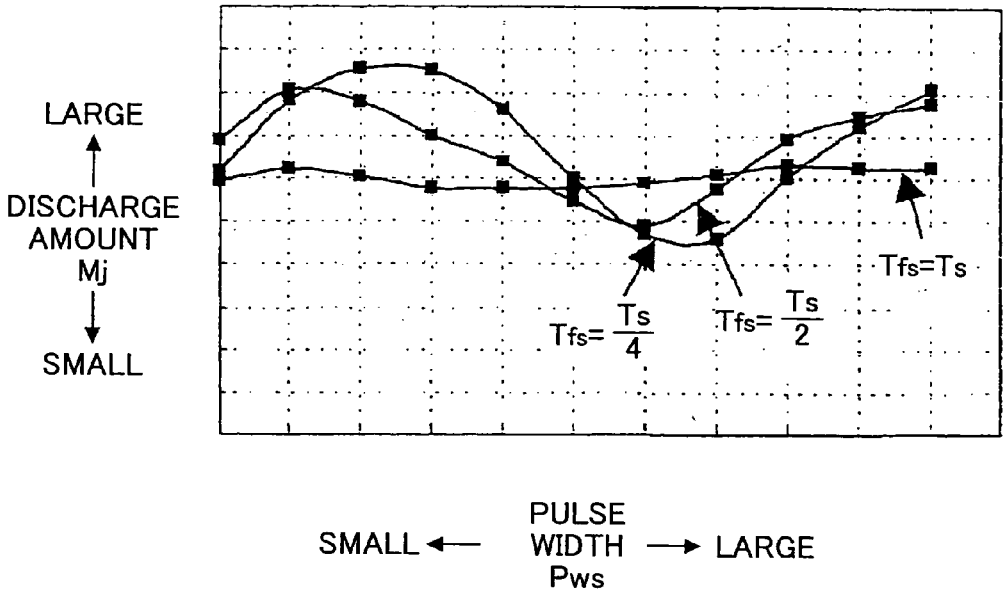
FIG. 27 shows dependency on the pulse width Pws for ink discharge amount Mj.

FIG. 26 shows dependency on the pulse width Pws for the ink discharge speed Vj, and FIG. 27 shows dependency on the pulse width Pws for ink discharge amount Mj. For both of them, three values are used for the time Tfs that is the time for applying the discharge pulse 201: one period Ts of the pressure vibration of the ink pressure chamber 106, a half of the period (Ts/2), and a quarter of the period (Ts/4). As shown in the figures, when the time Tfs is set to one period Ts, change amount for each of the ink discharge speed Vj and inc discharging amount Mj is small with respect to the pulse width Pws, since the pressure in the ink pressure chamber 106 diminishes while the discharge pulse 201 is applied due to interference. In consideration of this point, it is desirable that the time Tfs is set within a range (no more than Ts/2) in which interference of the pressure vibration in the inside of the ink pressure chamber 106 does not occur.

Figure 28:
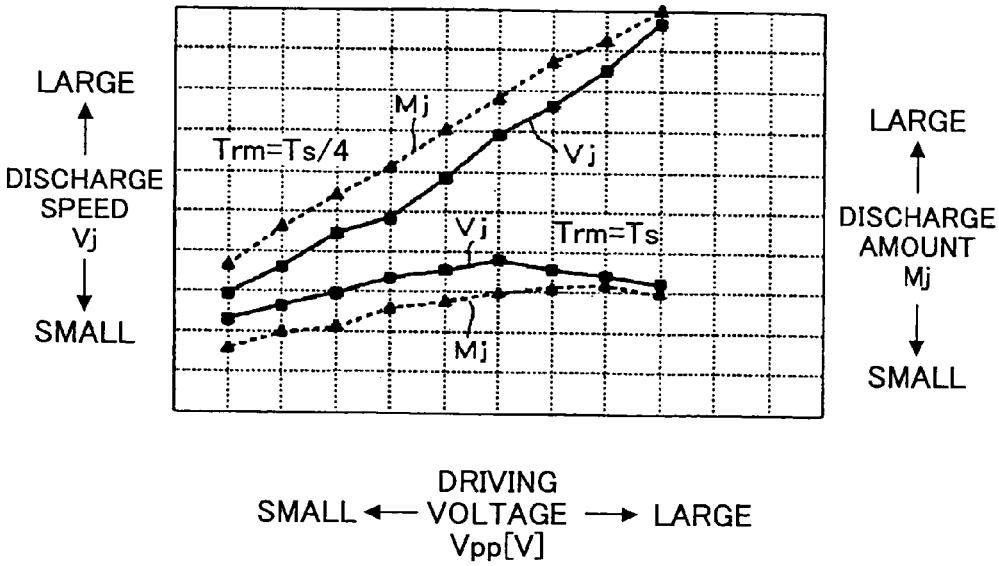
FIG. 28 shows dependency on ink discharge voltage Vpp for the ink discharge speed Vj and ink discharge amount Mj.

In addition, FIG. 28 shows dependency on ink discharge voltage Vpp for the ink discharge speed Vj and ink discharge amount Mj, wherein the time Trm that is the time for applying the charge pulse 203 is set to the one period (Ts) and a quarter of the period (Ts/4). As shown in FIG. 28, when Trm is set to one period (Ts), change amount of the ink discharge speed Vj and ink discharge amount Mj with respect to discharge voltage Vpp is small. The reason is also that the pressure in the ink pressure chamber 106 diminishes while the charge pulse 203 is applied due to interference. Therefore, in consideration of this point, it is desirable that the time Trm is set within a range (no more than Ts/2) in which interference of the pressure vibration in the inside of the ink pressure chamber 106 does not occur.

Figure 29:
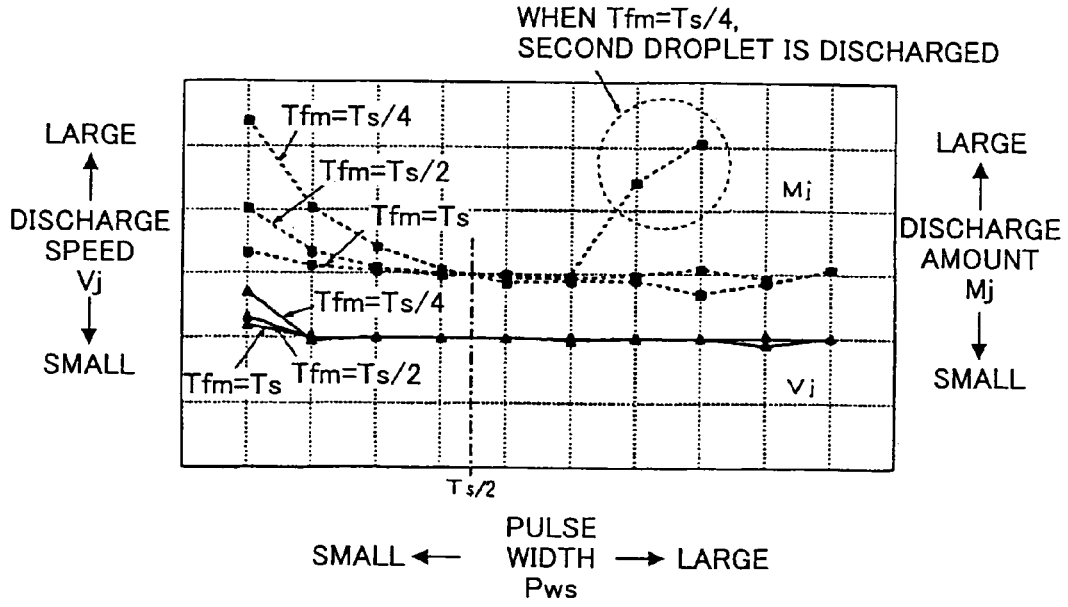
FIG. 29 shows dependency on the pulse width Pwm for the ink discharge speed Vj and ink discharge amount Mj.

FIG. 29 shows dependency on the pulse width Pwm of the pulse 204 for the ink discharge speed Vj and ink discharge amount Mj. For both of them, the time Tfm that is the time for applying the charge pulse 205 is set to the one period Ts, a half of the period (Ts/2), and a quarter of the period (Ts/4). When Tfm is set to a quarter of the period (Ts/4), a second ink discharge occurs when the pulse width Pwm is a value shown in the figure. That is, the charge pulse 205 is applied soon after a time when the pressure in the ink pressure chamber 106 becomes positive after ink discharge occurs. In addition, when the pulse width Pwm is small, both of the ink discharge speed Vj and ink discharge amount Mj increase, so that the effect for producing small ink droplets diminishes.

In order to avoid this problem, it can be considered to increase the time Trm for applying the charge pulse 203 so as to diminish pressure vibration. However, this method is not advisable since intended ink discharge speed Vj may not be obtained. Therefore, the charge pulse 205 is started to be applied after the pressure in the ink pressure chamber 106 becomes negative for the first time while remaining the charge pulse 203 unchanged. Accordingly, the above-mentioned the second ink discharge does not occur. In addition, by increasing the time for applying the charge pulse 205, pressure vibration in the ink pressure chamber 106 is decreased, so that the ink discharge does not occur.

As mentioned above, and as shown in FIG. 29, it is desirable that the fourth waveform element (pulse 204 (pulse width Pwm)) is set to be no less than Ts/2, and that the fifth waveform element (charge pulse 205) is set to be no less than Ts/2. FIG. 29 shows evaluation results when the period Ts is 9 μm.

According to the above-mentioned sixth embodiment, the image recording apparatus includes: a driver for driving the pressure generation part; wherein the driver outputs a driving signal including: a first waveform element for expanding the pressurizing chamber (ink pressure chamber); a second waveform element for keeping a expanded state of the pressurizing chamber; and a third waveform element for contracting the pressurizing chamber from the expanded state to discharge a droplet; wherein a pulse width of the second waveform element is determined such that droplet discharge speed is greater than a predetermined value.

In this invention, the pulse width of the second waveform element may be determined such that droplet discharge speed is maximum. According to this invention, the image recording apparatus can make the most of pressure vibration in the pressurizing chamber occurred by applying the first waveform element, so that an optimized small droplet can be obtained and the voltage of the third waveform element can be lowered.

In the above-mentioned image recording apparatus, the driver starts to apply the third waveform element at a time when a pressure in the pressurizing chamber becomes positive. Therefore, since the pulse width of the second signal can be set to be a value such that the droplet discharge speed is maximum, an optimized small droplet can be discharged. In addition, duration of the first waveform element is no more than Ts/2, wherein Ts is a period of pressure vibration in the pressurizing chamber. And, duration of the third waveform element is no more than Ts/2. Therefore, the image recording apparatus can make the most of pressure vibration in the pressurizing chamber occurred by applying the first waveform element, so that an optimized small droplet can be obtained In the image recording apparatus, the driving signal further includes: a fourth waveform element for keeping a state where contraction of the pressurizing chamber by the third waveform element ends; and a fifth waveform element for contracting the pressurizing chamber to a state corresponding to a state before the first waveform element is applied. According to this image recording apparatus, the number of change in the driving signal can be minimum, so that frequency characteristics can be improved and stable ink discharge can be realized. The duration of each of the fourth and fifth waveform elements is no less than Ts/2. Accordingly, resonance vibration can be suppressed in the ink pressure chamber after discharging ink by the third waveform element, so that discharge of useless ink droplet can be suppressed.

In the image recording apparatus, a potential difference between a start point of the first waveform element and the second waveform element is greater than a potential difference between the second waveform element and an end point of the third waveform element. Therefore, the image recording apparatus can make the most of pressure vibration in the pressurizing chamber caused by applying the first waveform element, so that an optimized small droplet can be discharged with a desired ink discharge speed.

In the following, the seventh embodiment of the present invention will be described. The structure of an inkjet recording apparatus in this embodiment is the same as that described with reference to FIGS. 3, 4, 21 and the structure of an inkjet head in this embodiment is the same as shown in FIG. 22.

The driver 113 is controlled by the control part 114, so that an ink droplet is formed by applying a driving signal to the inkjet head 112. That is, a driving signal having a following waveform in one period is used.

Figure 31:
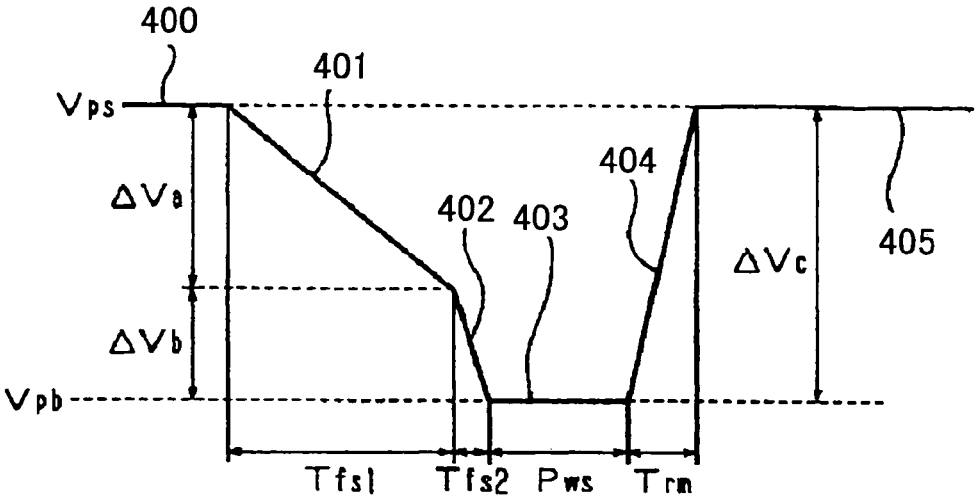
FIG. 31 shows a waveform of a driving signal according to a seventh embodiment of the present invention.

FIG. 31 shows the waveform of the driving signal. As shown in FIG. 31, the driving signal changes to a first waveform element (discharge pulse 401) from a holding pulse 400, in which the voltage falls from the maximum voltage Vps (holding pulse 400) at a first change rate (ΔVa/Tfs1). Next, the driving signal changes to a second waveform element (discharge pulse 402), wherein the voltage falls to a minimum voltage Vpb at a second change rate (ΔVb/Tfs2=constant) that is greater than the first change rate (ΔVa/Tfs1). Next, the driving signal changes to a third waveform element (holding pulse 403) that keeps the minimum voltage Vpb for a predetermined time (pulse width Pws). Finally, the driving signal changes to a fourth waveform element (charge pulse 404) in which the voltage rises from the minimum voltage Vpb to the maximum voltage Vps at a third change rate (ΔVc/Trm=constant). After that, the signal returns to a holding pulse 405, so that one cycle of the driving signal ends. After that, the driving signals are output continuously while the cycle from the holding pulse 400 to the holding pulse 405 is repeated.

Figure 32:
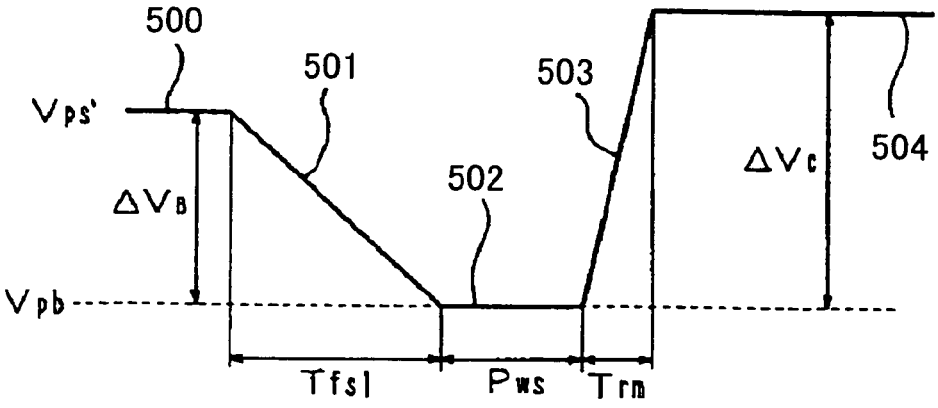
FIG. 32 shows a waveform of a conventional driving signal for comparing with the waveform shown in FIG. 31.

FIG. 32 shows a waveform of a conventional driving signal for comparing with the waveform shown in FIG. 31. In the following, comparison between the pulse waveform shown in FIG. 31 (waveform A) and the conventional pulse waveform (waveform B) shown in FIG. 32 will be described.

Figure 33:
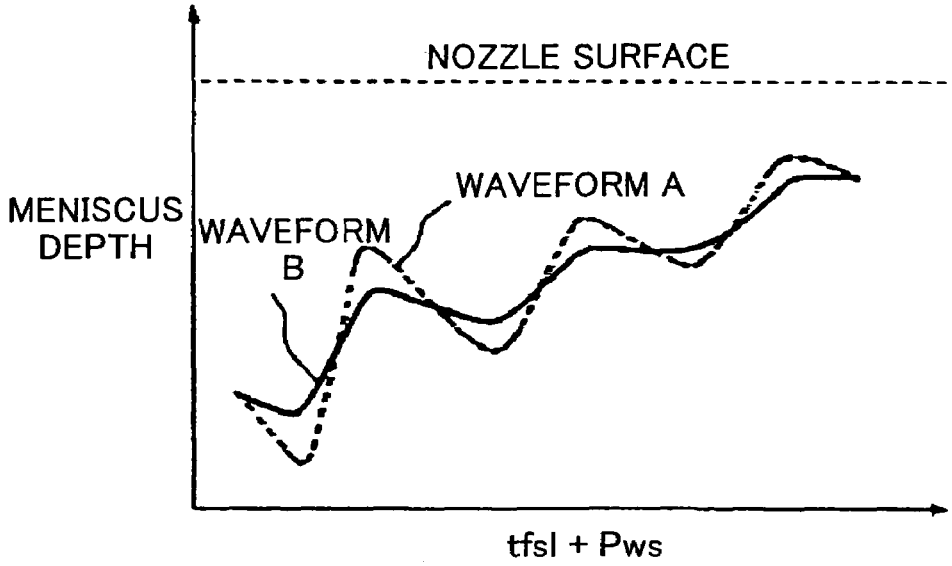
FIG. 33 shows a relationship between a time (Tfs1+Pws) for pulling and the meniscus depth.

The discharge pulse 401 in the waveform A and the discharge pulse 501 in the waveform B have the same change rate (ΔVa/Tfs1) and the same potential difference (ΔVa). The charge pulse 404 in the waveform A and the charge pulse 503 in the waveform B have the same change rate (ΔVc/Trm) and the same potential difference (ΔVc). FIG. 33 shows a relationship between a time (Tfs1+Pws) for pulling and the meniscus depth. As shown in FIG. 33, the meniscus depths for the waveforms A and B are almost the same since the change rates (ΔVa/Tfs1 and ΔVc/Trm) and the potential differences (ΔVa and ΔVc) are the same.

In the waveform A, pressure in the ink common fluid chamber 105*a* can be caused by applying the discharge pulse 402 having the second change rate (ΔVb/Tfs2) greater than the first change rate (ΔVa/Tfs1) subsequent to the discharge pulse 401. Since change rate of the discharge pulse is proportional to the amplitude of vibration of the pressure in the ink common fluid chamber 105*a*, by using the second change rate greater than the first change rate, the pressure in the ink common fluid chamber 105*a* is greater than that when using the first change rate. In addition, the same effect can be obtained by setting the time for applying the discharge pulse 401 to be longer than the time for applying the discharge pulse 402.

Figure 34:
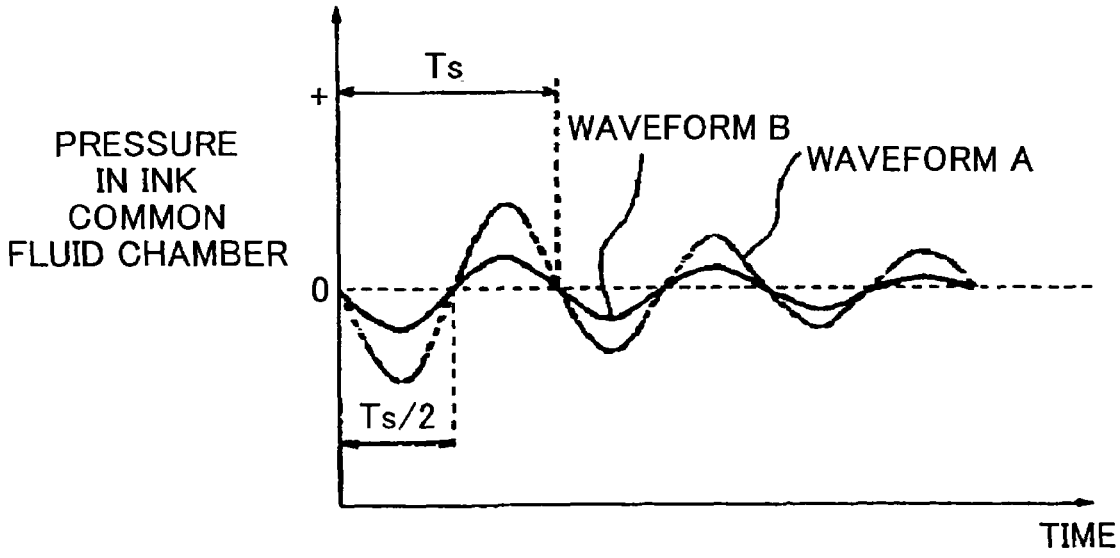
FIG. 34 shows a relationship between the time for pulling ink and the pressure in the ink common fluid chamber 105*a;*

Therefore, as shown in FIG. 33, when the inkjet head 112 is driven by using the waveform A, meniscus change due to the pressure in the ink common fluid chamber 105*a* caused by applying the discharge pulse 402 is added. FIG. 34 shows a relationship between the time for pulling ink and the pressure in the ink common fluid chamber 105*a*. The point where the time is 0 indicates the start time for applying the discharge pulse. At this time, the pressure in the ink common fluid chamber 105*a* is also 0. When the discharge pulse is applied, pressure vibration occurs. Also in this case, when the inkjet head 112 is driven by the waveform A, since the meniscus change caused by the pressure in the ink common fluid chamber 105*a* by applying the discharge pulse 402 is added, the amplitude of the pressure vibration in the ink common fluid chamber 105*a* becomes large.

As shown in FIG. 34, the pressure in the ink common fluid chamber 105*a* performs damped vibration while repeating positive pressure and negative pressure at a period Ts determined by factors such as the structure of the ink pressure chamber 106, a diameter of the nozzle 107, and ink fluid resistance. The pressure becomes negative from the start of pulling to a half of the period (Ts/2), and magnitude of the vibration is largest at the time. After that, the pressure is positive during a time from the half of the period (Ts/2) to one period Ts. Therefore, in the waveform A shown in FIG. 31, by setting the time Tfs1 for applying the discharge pulse 401 to be a value larger than a half of one period (Ts/2), ink supply from the fluid resistance part by negative pressure in the ink common fluid chamber 105*a* can be smallest. As a result, a large meniscus depth can be obtained.

Magnitude of the pressure in the ink common fluid chamber 105*a* is largest in the interval from the start to the half of the period (Ts/2). After that, vibration of the pressure is gradually damped. Therefore, by setting the time Tfs2 for applying the discharge pulse 402 in the waveform A in FIG. 31 to be smaller than the half of the period (Ts/2), maximum pressure can be obtained, so that a large pressure in the ink common fluid chamber 105*a* can be obtained.

Figure 35:
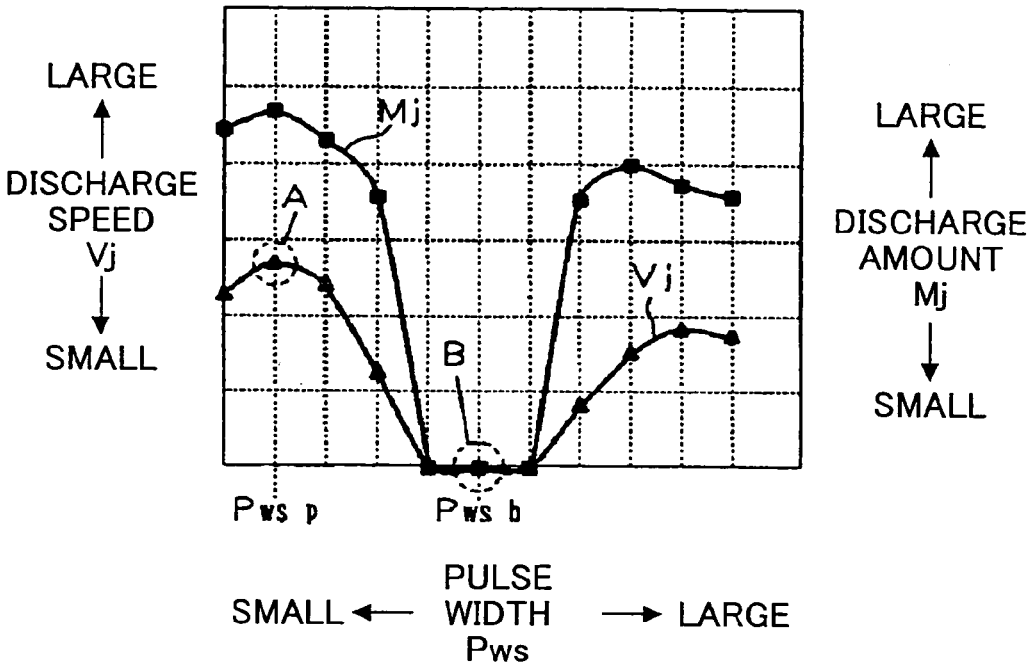
FIG. 35 shows a relationship between the pulse width and ink discharge amount/ink discharge speed.
Figure 36:
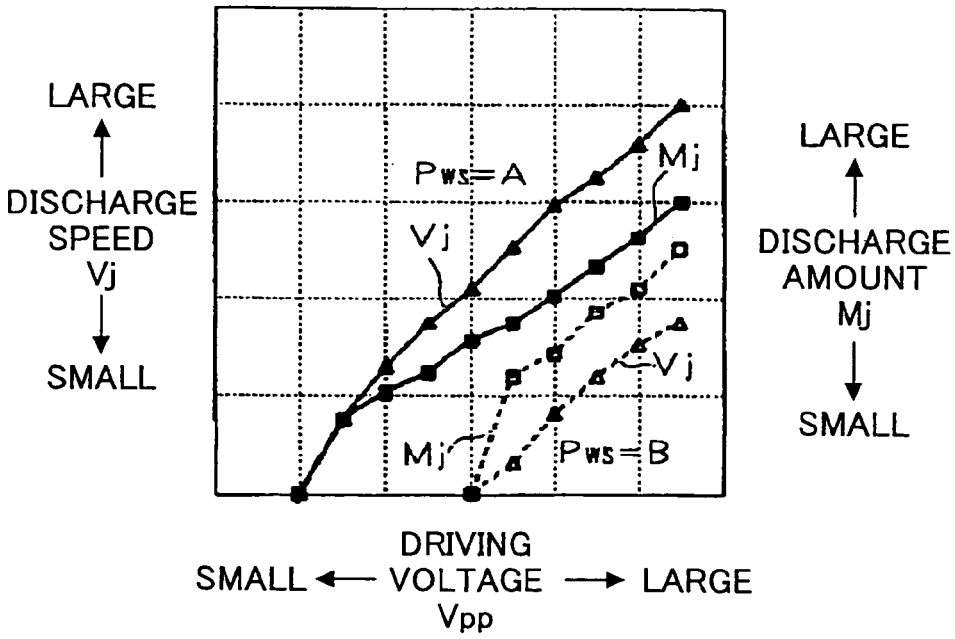
FIG. 36 shows a relationship between the driving voltage and ink discharge amount/ink discharge speed.

When using the driving signal shown in FIG. 31, the ink discharge speed Vj and ink discharge amount Mj repeatedly increase and decrease at a period almost the same as that for the pressure vibration of the ink pressure chamber 106 as shown in FIG. 35. Therefore, by determining the pulse width Pws of the third waveform element such that the charge pulse 404 is applied at a timing when the pressure in the ink pressure chamber 106 becomes positive (point A in FIG. 35), the ink discharge speed becomes maximum. In addition, by using this timing, the ink discharge amount also becomes maximum. Accordingly, by selecting the pulse width Pws properly, ink is discharged even when potential difference ΔVc (driving voltage Vpp) of the charge pulse 404 is small as shown in FIG. 36, a small potential difference ΔVc (a small driving voltage) can be used for the charge pulse 404. FIG. 36 shows changes of the ink discharge speed Vj and ink discharge amount Mj with respect to the driving voltage for each of pulse widths Pws corresponding to peak point (A) and to bottom point (B). By using small potential difference ΔVc, the amount of volume change of the ink pressure chamber 106 can be decreased when discharging an ink droplet, so that ink discharge amount can be further decreased.

Figure 37:
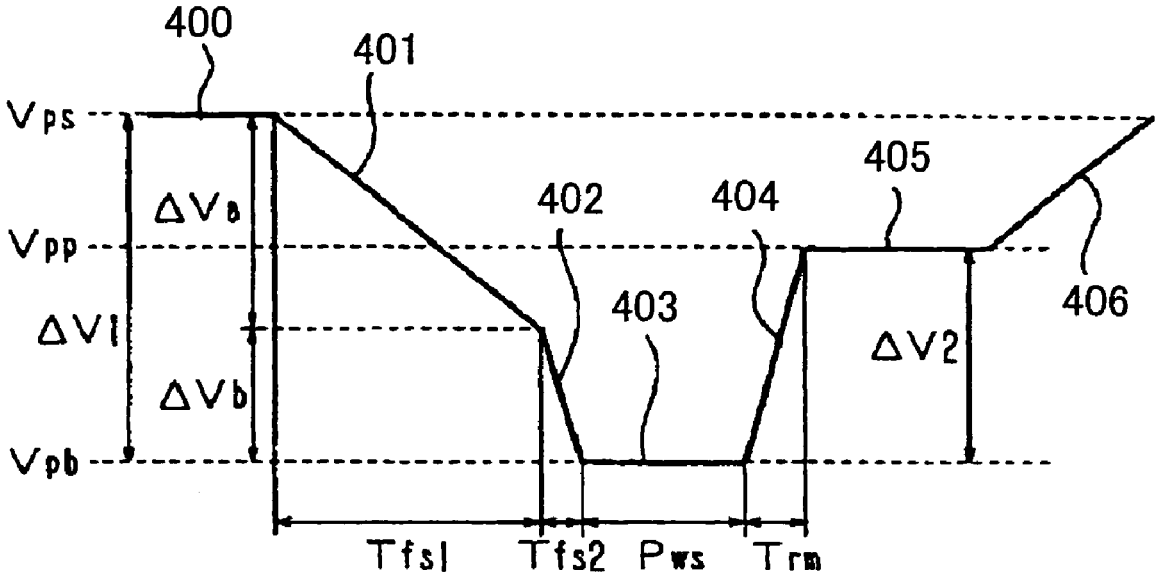
FIG. 37 shows another waveform of a driving signal according to a seventh embodiment of the present invention.

Thus, instead of the driving signal A shown in FIG. 31, another pulse waveform shown in FIG. 37 can be used for driving the inkjet head 112. That is, in FIG. 37, a potential difference ΔV2 between Vpb and Vpp (between the holding pulse 403 and the holding pulse 405) is smaller than the potential difference ΔV1 (ΔVa+ΔVb) between Vps and Vpb (between the holding pulse 400 and the holding pulse 403). After the holding pulse 405 is output, the charge pulse 406 is output, such that voltage rises from the driving voltage Vpp to the maximum voltage Vps. Accordingly, the size of the ink droplet can be decreased while a desired discharge speed is obtained.

According to the above-mentioned seventh embodiment of the present invention, the image recording apparatus includes a droplet discharging head, the droplet discharging head comprising a pressurizing chamber, a fluid supply chamber connected to the pressurizing chamber, a nozzle connected to the pressurizing chamber, a pressure generation part for contracting and expanding the volume of the pressurizing chamber, the image recording apparatus further includes: a driver for driving the pressure generation part; wherein the driver outputs a driving signal including: a first waveform element for expanding the pressurizing chamber by causing a first pressure in the pressurizing chamber; a second waveform element for expanding the pressurizing chamber by causing a second pressure larger than the first pressure in the pressurizing chamber; a third waveform element for keeping an expanded state of the pressurizing chamber expanded by the second waveform element; and a fourth waveform element for contracting the pressurizing chamber from the expanded state to discharge a droplet.

According to this embodiment, the first waveform element enables to slow the speed of expanding the volume of the pressurizing chamber, so that the pressure in the fluid supply chamber (ink supply chamber) can be decreased and ink supply from the fluid supply chamber can be slowed. As a result, the meniscus can be pulled by using the first waveform element. Then, the second signal enables to increase the speed of expanding the volume of the pressurizing chamber to increase the pressure in the fluid supply chamber. As a result, voltage used for discharging ink can be decreased. Thus, a small droplet can be obtained while enough droplet discharge speed is kept.

In the image recording apparatus, each of the first and second waveform elements forms a discharge pulse, and the fourth waveform element forms a charge pulse. Therefore, a small droplet can be obtained while enough droplet discharge speed is kept.

In addition, in the image recording apparatus, a voltage change rate of the second waveform element is greater than a voltage change rate of the first waveform element. In addition, the duration of the first waveform element may be longer than duration of the second waveform element. Therefore, large pressure can be generated in the ink pressure chamber when the second signal is applied, so that a small droplet can be obtained while enough droplet discharge speed is kept.

In the image recording apparatus, the duration of the first waveform element is no less than Ts/2, and the duration of the second waveform element is no more than Ts/2.

In the image recording apparatus, duration of the third waveform element is determined such that droplet amount discharged from the nozzle becomes maximum. Therefore, the image recording apparatus can make the most of pressure vibration in the pressurizing chamber occurred by applying the second waveform element, so that an optimized small droplet can be obtained and the voltage of the fourth waveform element can be lowered.

In addition, in the image recording apparatus, a potential difference between a start point of the first waveform element and the third waveform element is greater than a potential difference between the third waveform element and an end point of the fourth waveform element. Therefore, the nozzle meniscus can be pulled deeply, so that the volume of ink occupying the nozzle can be decreased, and volume change of the ink pressure chamber for discharging ink can be decreased. Thus, a small droplet can be discharged.

The present invention is not limited to the specifically disclosed embodiments, and variations and modifications may be made without departing from the scope of the invention.

The invention claimed is:

1. An image recording apparatus including a droplet discharging head comprising a pressure generation part for contracting and expanding volume of a pressurizing chamber connected to a nozzle in said droplet discharging head, said image recording apparatus further comprising:

a part for outputting a driving signal that includes time-series driving pulses each for contacting the volume of said pressurizing chamber to discharge a droplet in a driving period;

wherein parameters for each of said driving pulses are determined such that an equation $tr + Pw + tf + td = n \times Ts$ holds true, wherein tr is a rising time constant, Pw is a pulse width, tf is a falling time constant, td is a pulse interval, Ts is a resonance frequency of the pressure in said pressurizing chamber, and n is an integer no less than 1.

2. The image recording apparatus as claimed in claim 1, wherein n in said equation is 2 or 3.

3. The image recording apparatus as claimed in claim 1, wherein, as for adjacent two driving pulses with respect to time in said time-series driving pulses, n in said equation for one said adjacent driving pulse is greater than n for the previous said adjacent driving pulse.

4. The image recording apparatus as claimed in claim 1, wherein an equation $Pw + tf = (n + 1/4) \times Ts$ holds true for the last driving pulse in said time-series driving pulses.

5. The image recording apparatus as claimed in claim 4, wherein tf is greater than Ts for said last driving pulse.

6. The head driving control apparatus for controlling a pressure generation part that contracts and expands volume of a pressurizing chamber connected to a nozzle in a droplet discharging head, said head driving control apparatus comprising:

a driving waveform generation part for outputting a driving signal including:

a first waveform element for contracting the volume of said pressurizing chamber without discharging droplet;

a second waveform element for keeping the contracted state in which the volume of said pressurizing chamber is contracted until a meniscus in said nozzle moves toward said pressurizing chamber;

a third waveform element for expanding the volume of said pressurizing chamber from said contracted state;

a fourth waveform element for keeping the expanded state of the volume of said pressurizing chamber; and a fifth waveform element for contracting the volume of said pressurizing chamber from said expanded state to discharge a droplet, wherein said third waveform element is applied after the meniscus in the nozzle moves toward the pressurizing chamber.

* * * * *